US008322282B2

(12) United States Patent
Burgess et al.

(10) Patent No.: US 8,322,282 B2
(45) Date of Patent: Dec. 4, 2012

(54) APPARATUS AND PROCESS FOR TRANSPORTING LITHOGRAPHIC PLATES TO A PRESS CYLINDER

(75) Inventors: Dennis M. Burgess, Wayzata, MN (US); William J. Campbell, Minnetonka, MN (US)

(73) Assignee: Burgess Industries, Inc., Plymouth, MN (US)

( * ) Notice: Subject to any disclaimer, the term of this patent is extended or adjusted under 35 U.S.C. 154(b) by 492 days.

(21) Appl. No.: 12/587,814

(22) Filed: Oct. 14, 2009

(65) Prior Publication Data

US 2010/0037792 A1 Feb. 18, 2010

Related U.S. Application Data

(62) Division of application No. 11/752,254, filed on May 22, 2007, now Pat. No. 7,610,855.

(60) Provisional application No. 60/808,083, filed on May 24, 2006.

(51) Int. Cl.
*B41B 47/14* (2006.01)

(52) U.S. Cl. ..... 101/477; 101/480

(58) Field of Classification Search ..... 101/415.1, 101/477, 479, 480; 414/796.7, 796.8
See application file for complete search history.

(56) References Cited

U.S. PATENT DOCUMENTS

| | | | | |
|---|---|---|---|---|
| 2,610,577 | A | 9/1952 | Heintges | |
| 4,539,794 | A * | 9/1985 | Azzaroni | 53/493 |
| 5,809,360 | A | 9/1998 | Blake | |
| 6,018,356 | A * | 1/2000 | Morimura et al. | 347/215 |
| 6,135,698 | A * | 10/2000 | Bonora et al. | 414/416.01 |
| 6,209,704 | B1 * | 4/2001 | Pauling et al. | 198/404 |
| 6,280,134 | B1 * | 8/2001 | Nering | 414/217 |
| 6,341,932 | B1 | 1/2002 | Otsuji | |
| 6,644,191 | B2 | 11/2003 | Narui | |
| 7,055,431 | B2 * | 6/2006 | Blake et al. | 101/477 |
| 7,069,859 | B2 * | 7/2006 | Usui | 101/494 |
| 2004/0187723 | A1 * | 9/2004 | Koizumi et al. | 101/477 |

* cited by examiner

*Primary Examiner* — Ren Yan
(74) *Attorney, Agent, or Firm* — Nikolai & Mersereau, P.A.; Thomas J. Nikolai

(57) ABSTRACT

Transportation of a lithographic plate uses an indexer to load plates into pods for delivery to a press cylinder via a pod elevator or a pod cart. The plates are imprinted with a bar code, imaged, punched, bent, sheared, corner notched, and registered to a press cylinder. The plates are loaded into the indexer, which moves the loaded plates into a position in alignment with designated pod compartments, and loads the plates into each of the designated pod compartments by indexed movement of an elevator within the indexer. The pod elevator or the pod cart moves the pods proximate to a press cylinder where the plates are unloaded from the pod and loaded onto a press cylinder. A computing device, such as a PLC, directs the process. A vision system senses information from the indexer, pod, pod elevator, and the plate for feedback to a PLC, which initiates all of the foregoing operations.

12 Claims, 26 Drawing Sheets

230
202B
230
230
230

APPARATUS AND PROCESS FOR TRANSPORTING LITHOGRAPHIC PLATES TO A PRESS CYLINDER

CROSS REFERENCE TO RELATED APPLICATION

This application is a divisional application of U.S. Utility patent application Ser. No. 11/752,254 filed May 22, 2007, which application claims the benefit of U.S. Provisional Patent Application Ser. No. 60/808,083 filed May 24, 2006.

FIELD OF TECHNOLOGY

The technology disclosed in this specification is in the field of lithographic plate management and handling for web offset printing. The technology embodies a bar coded (or other coded) apparatus and process for transporting lithographic plates to a press cylinder.

BACKGROUND

The apparatus and process for transporting lithographic plates to a press cylinder described in this specification has particular (albeit not exclusive) application to management and handling of thin, flexible, lithographic printing plates in high rotational speed press operations.

An embodiment of an apparatus for transporting lithographic plates described herein is comprised of an indexer, a pod, and a pod elevator. Another embodiment of an apparatus for transporting lithographic plates is comprised of an indexer and a cart pod.

An embodiment of the process for transporting lithographic plates to a press cylinder most often operates in conjunction with an over-arching lithographic plate management and handling system. The system directs the operation of the indexer, pod, and pod elevator. Among other duties under its control, the system codes each plate. The code contains information, which the system PLC reads at various steps along the way of preparing lithographic plates for use on a printing press. The system uses the information to direct the plate along the correct and ultimate route to the printing press, including delivering the plate to an indexer, signaling the indexer to load the plate into various pod compartments, and using a pod elevator for transporting the plates to a press cylinder.

The indexer, pod, and pod elevator may be used to load, contain, and transport lithographic plates for web-offset printing, for non web-offset printing, or for non-printing applications. The operation of the indexer, the pod, and the pod elevator is described in this specification in conjunction with computerized system. However, the indexer, pod, and pod elevator may be operated without direction from a computerized system.

The web offset printing operation is highly automated. The heart of the operation is one or more high speed presses designed for efficient mounting and removal of lithographic plates. Each plate must be precisely mounted on the press' plate-mounting cylinder to ensure that the lithographic plate image is in exact registration, i.e., "square" with the press cylinder when in the manufacturer's locked-up position.

In addition to the high rotational speed press—the hub of the operation—the printing operation must have a high speed means of management and handling of the lithographic plates. Management and handling includes identification of each lithographic plate in the system and on-time transportation of the plate to the press or presses. The means of identification and transportation of plates includes a plethora of modules, of which an indexer, pod, and pod elevator are a part. Such modules may perform (a) imaging and processing of plates, including bar coding of each plate for identification purposes; (b) image to plate registration and plate to cylinder registration; (c) plate punching, bending, shearing, corner notching/cutting; (d) direction of work flow and plate traffic routing, including optical registration verification, plate inspection, bar-code scanning, and remote diagnostics; (e) on-time delivery of plates to the press, including sorting, stacking, and conveying the plates (using, for example, plate entry modules, rotators, indexers, stackers, crossover bridges, elevators, thru-the-wall transport modules, dual highway modules, auto plate feeders, dummy plate loaders, and conveyors; (f) plate storage (in pods or on stacking cart pods), delivery of pods to storage, and rack storing of pods; and (g) automated retrieval from storage of the indexed plates. The identification and transportation of plates (and the modules which carry-out these functions) must be synchronized with one another and with the press to ensure that the plates are transported to the correct place at the correct time and the various operations on the plates are done timely and properly.

The competitive, low-margin economics of the printing business requires that the press not only be high speed, but so must the management and handling of lithographic plates. In this environment, the plate management and handling infrastructure must be fast, efficient, automated, and reliable to complement the printing process and workflow environment. The plate management and handling system employed cannot be allowed to contribute to press down time and image register problems. The system must ensure the continuous process flow of press-ready, in-register plates for each press cylinder with repeatable results.

The embodiments of the lithographic plate management and handling system of the present invention and its automated and synchronized, modular components are designed to meet these goals by integrating the entire printing workflow into one efficient system. The lithographic plate management and handling system feeds the press with the lithographic plates. The integrated system is designed to fully automate plate management and handling and reduce operator involvement in the printing process and workflow environment, whether it be in-line or off-line. Such integrated system spans the photographic process of imprinting an image on a lithographic plate to locking up the plate on the press.

The embodiments of an indexer, pod, and pod elevator and the other components of the system are all designed to automate the workflow of a printing production environment and to produce press-ready plates for applications using different levels of press technology, multiple press types, and multiple press register requirements. No one printing operation is the same, so the indexer, pod, and pod elevator and the other components of system are designed to be flexible in design and configuration. They are designed to be an integrated system with the flexibility to be custom-configured in many different ways. Moreover, the indexer, pod, and pod elevator and the other components of the system described herein range from fully automated to un-automated, depending upon the needs of a particular user application.

SUMMARY

The process for transporting lithographic plates uses an indexer to load plates into a pod compartment for delivery to a press cylinder. The plates are imprinted with a machine readable code, such as bar code. The process includes imaging and processing the plates and punching, bending, shearing, and corner notching the plates. Registration of the plate to a press cylinder occurs during imaging and bending the plate. Registration of the plates occurs when a plate can be precisely located on a press cylinder in accordance with the press manufacturer's plate lock-up specifications, including tolerances.

A conveyor moves the imaged plate to an indexer. The plates delivered to the indexer are already imaged, processed, punched, bent, sheared, and corner notched, as required, and in register. They are loaded into the indexer and the indexer moves the loaded plates into a position in alignment with designated pod compartments corresponding to bar code information. The indexer loads the plates into each of the designated pod compartment by indexed movement of the indexer's elevator to align the designated plates with each of the plates corresponding pod compartments. A pod elevator moves the pods proximate to a press cylinder where the plates are manually unloaded from the pod and loaded onto a press cylinder.

A computing device, such as a PLC, directs the process. The computing device has a memory for storing parameters corresponding to virtual locations of modules, such as a conveyor, the indexer, the pod, a pod compartment, a pod elevator, and a press cylinder. The computer stores physical locations of all of the plates at the various stages along the way to the press cylinder, machine readable codes on the plates, feedback information from the modules, and instructions for directing movement of the plates along routes based upon preset parameters. The computer includes a processor for executing the instructions, an input channel for receiving and storing the commands and the parameters, and an output channel for sending the instructions to a module for directing an operation and moving the plates along prescribed routes on a non-collision basis. A vision system is used for sensing information from a module and from a plate for feedback to a PLC, which initiates operations of a module and for bar-code scanning.

The plate indexer has a box frame, housing, elevator, indexer conveyor, plate centering assemblies, and plate finger pushers. An internal frame is secured to the box frame for support of the elevator. The elevator is vertically movable within the frame and the housing and in a first position the elevator is in a plate loading position and in a second position the elevator is in a plate exiting position. The elevator is raised and lowered by a drive motor having a worm gear assembly and a speed reduction adapter. The indexer conveyor has one or more horizontally, rollable conveyor belts and a means for rollably moving the belts. The plate centering assemblies include a means for pushing the plate into lateral registration with the belts. At least one assembly positioned on each longitudinal side of the plate. Finger pushers are mounted on each longitudinal side of the plate for gripping the plate with the finger springs and thereby move the plate into registration with the bed of the elevator. The plate assist assembly has a rodless cylinder mounted over the top of the indexer conveyor in a direction parallel to movement of the belts, a first a sensor for detecting the trailing edge of a plate and in response thereto the PLC signals the plate assist assembly to move the plate into a pod compartment and thereafter return to its start position.

The pod is a combination of a housing, partitioned compartments within the housing, a support bracket spanning the housing for rotatably mounting the pod in a pod elevator, a hangar for supporting a plate when the pod is in a vertical position within the pod elevator, a means for engaging a bend on the plate with the hangar, and a means for ejecting a plate from of the pod. The housing includes an enclosure, a retainer opposite the enclosure, the partitioned compartments between the enclosure and the retainer, and a support bracket spanning the enclosure, the compartments, and the retainer for rotatably mounting the pod in a pod elevator.

Each pod has multiple compartments, support brackets, hangars, a dual rod cylinder for engaging a bend on the plate, an ejecting for ejecting the plate. The compartments are vertically spaced apart parallel partitions. Upper pod support brackets are on an upper pod and lower pod support brackets are on a lower pod. The plates are loaded in a horizontal position. The assigned pod compartments are successively loaded with corresponding coded plates by incremental movement of the indexer elevator.

The pod elevator employed swivels the pods and their contained plates into a vertical position and transports the pods in a pod elevator proximate to a press cylinder. The support brackets have apertures for rotatable engagement with a pivot shaft of the pod elevator. A signal is sent to open a pod door, eject the plate from a designated pod compartment, and upon reaching the end of a plate ejector's travel retract the ejector to its home position.

The pod elevator transports the pods proximate the press cylinder. It is comprised of a frame, an outer carriage movable within the frame, an upper pod movable within the outer carriage, an inner carriage movable within the outer carriage, and a lower pod movable within the inner carriage. The frame is constructed of frame members, mounting frame members, back frame members, stabilizers, cross-members, and legs. The frame is built in two sections, which are a frame top portion and a frame bottom portion. The top portion is cantilevered over the bottom portion. The outer carriage is a combination of a frame with left and right side channels and top and bottom angle brackets, a guide rail affixed to the inside of the left channel, a guide rail affixed to the inside of the right channel, two guide roller assemblies mounted on the top angle bracket positioned to the left and right of the side channels, two guide roller assemblies mounted on the bottom angle bracket positioned to the left and right of the side channels, a cable cylinder mounted to the top and the bottom angle brackets and a cable attached to a top angle bracket of the inner carriage by a cable travel stop, a rotatable shaft in opposing end bearings, the bearings affixed to the left and the right side channels, a pivot affixed at one end in a pre-determined angular position to the shaft and rotatably connected at the other end to a cylinder and the top end of the cylinder rotatably connected to the bottom of the top angle bracket. The inner carriage includes a frame with left and right side channels and top and bottom angle brackets, four guide roller assemblies mounted on the top and the bottom angle brackets positioned outside of the left and right side channels, a shaft in end bearings, a pivot affixed between the shaft and a cylinder rod and the cylinder pivotally affixed to the top angle bracket. The pod elevator can have a number of pods within it, but the embodiment shown in this specification has two pods. Support brackets are on top of the upper pod and support brackets are on the bottom of the lower pod. The outer carriage has a rotatable shaft in opposing end bearings, the bearings affixed to left and right side channels and one end of a pivot affixed to the shaft in a pre-determined angular position, the other end of the shaft rotatably affixed to a cylinder, and the top end of the cylinder rotatably affixed to the top angle bracket.

An upper pod is rotatably affixed on the shaft by insertion of the shaft though apertures in the upper support brackets.

The outer carriage cylinder is actuated to extend the rod downward to clockwise rotate the shaft and the upper pod 90° upward.

The inner carriage is comprised of a rotatable shaft in opposing end bearings, the bearings affixed to the left and right side channels and one end of a pivot affixed to the shaft in a pre-determined angular position, the other end of the shaft rotatably affixed to a cylinder, and the top end of the cylinder rotatably affixed to the top angle bracket. The lower pod is rotatably affixed on the shaft by insertion of the shaft though apertures in the lower support brackets. The inner carriage cylinder is actuated to extend the rod downward to clockwise rotate the shaft and the lower pod 90° upward.

The elevator has the following modes of operation: load plate mode, separate pod mode, rotate pod mode, lower pod mode, eject plate mode, and return home mode.

In the load plate mode, the upper pod is positioned horizontally on the upper shaft in the outer carriage, the lower pod is positioned horizontally on the lower shaft in the outer carriage, the bottom of the upper pod abuts the top of the lower pod, whereby the indexer can load the upper and lower pods as if they were a single pod.

In the separate pod mode, the horizontal upper pod remains stationary and the horizontal lower pod separate from the upper pod by movement of the inner carriage downward to the bottom of the outer carriage at least a distance from the outside of the channel shaped retainer to the outside of the enclosure.

In the rotate pod mode the upper and lower pods are rotated upward from their horizontal positions to vertical positions.

In the lower pod mode the outer carriage moves along with the vertical upper pod, towards the bottom of the elevator, the inner carriage, located at the bottom of the outer carriage, moves along with the vertical lower pod to the bottom of the elevator, wherein the upper pod remains in it vertical position about the vertically positioned lower pod.

In the eject plate mode designated plates are ejected from compartments in the upper and lower pods.

In the return home mode the elevator is directed to return to its home position for loading. The inner carriage cylinder is actuated to extend the rod downward to clockwise rotate the shaft and the lower pod 90°.

DESCRIPTION OF THE PREFERRED EMBODIMENTS

System Level

Figure 19:
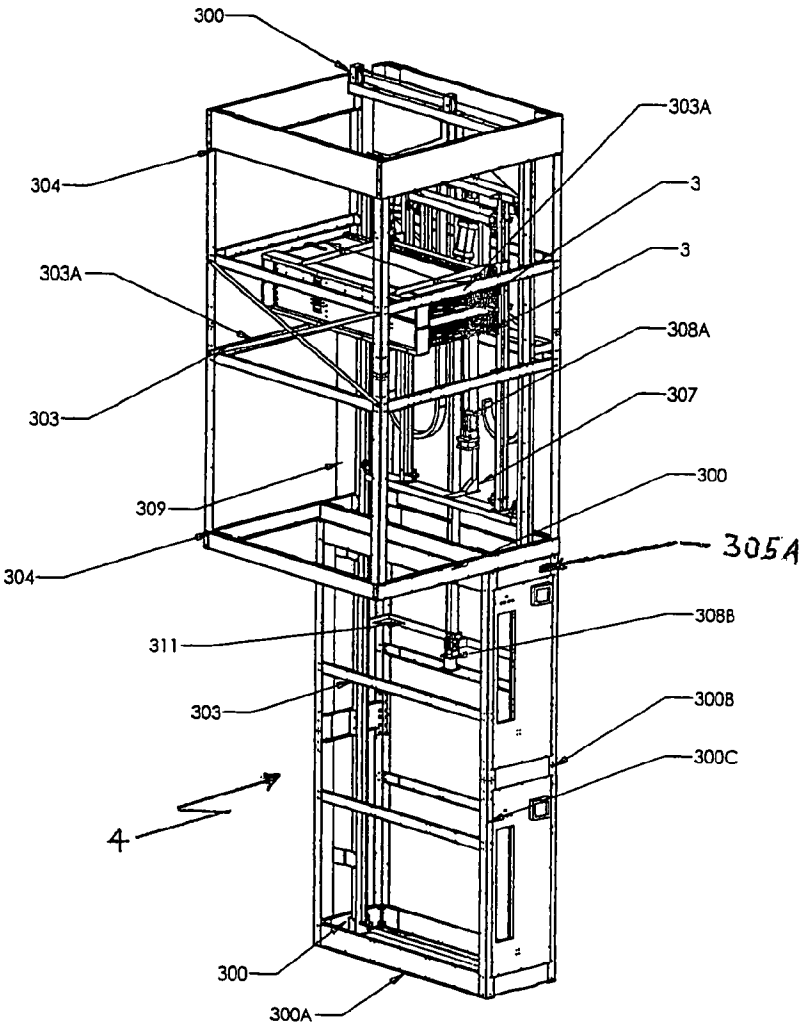
FIG. 19 is a perspective view of an embodiment of the pod elevator in the load plate mode.

The lithographic plate management system of the present invention is comprised of modules arranged in differing configurations to form myriad work flow arrangements. The main working modules are the imager 18, image processor 9, punch/bender 19, indexer 2, pod 3, and pod elevator 4 (FIG. 19). These modules are serviced by transport modules of various kinds. The system provides plate traffic control and tracking along the entire transport route. Some transport modules 8, under control of a system PLC, transport plates forward or backward and right or left. They pause, hold, stop, start, slow down, speed up, rotate, index, sort, stack, elevate, or eject. The transport modules move press-ready plates to designated printing press locations.

Selected Modules

Plate indexer 2 receives the press-ready lithographic plates from belt transporter 8 or some other module in system 1 and loads each plate into a designated compartment of a pod 3 for delivery to the press. Pod 3 has several compartments that are separated from one another by parallel partitions, each of which is in a separate vertically spaced position. A pod elevator 4 moves the pods vertically from indexer 2 level to a second level on which the printing press is located.

A system controller (not shown) includes a programmable logic controller (PLC). It is the operating brain of system. It supervises the entire plate management and handling system. Among other things, it manages, monitors, and controls plate flow, system operation, alarms, and fault detection. It reports the need for preventative maintenance and does trouble-shooting.

Production Line Configurations

Figure 1:
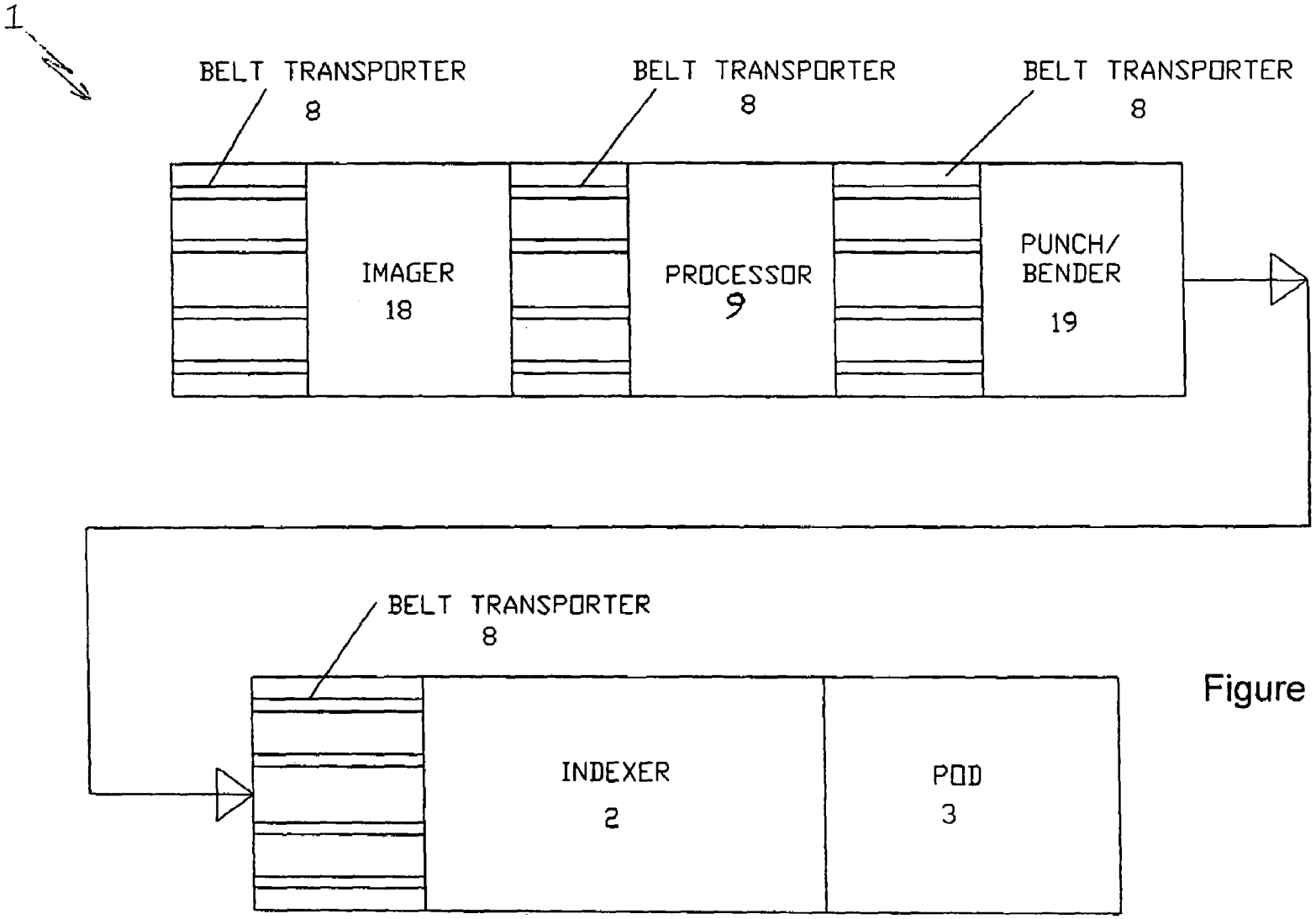
FIG. 1 is a diagrammatic view of an embodiment of a production line configuration of the system, which includes an indexer and pod.

An embodiment of the lithographic plate management and handling system is illustrated in FIG. 1, a plan view. The main elements of system include imaging module 18, plate rotation module (not shown), multi-directional plate transfer module to change the direction of flow of the plate after leaving the imaging module 18, processor 9 for developing the image, a plate stacker, and a plate punch/bender module 19.

Indexer

Figure 9:
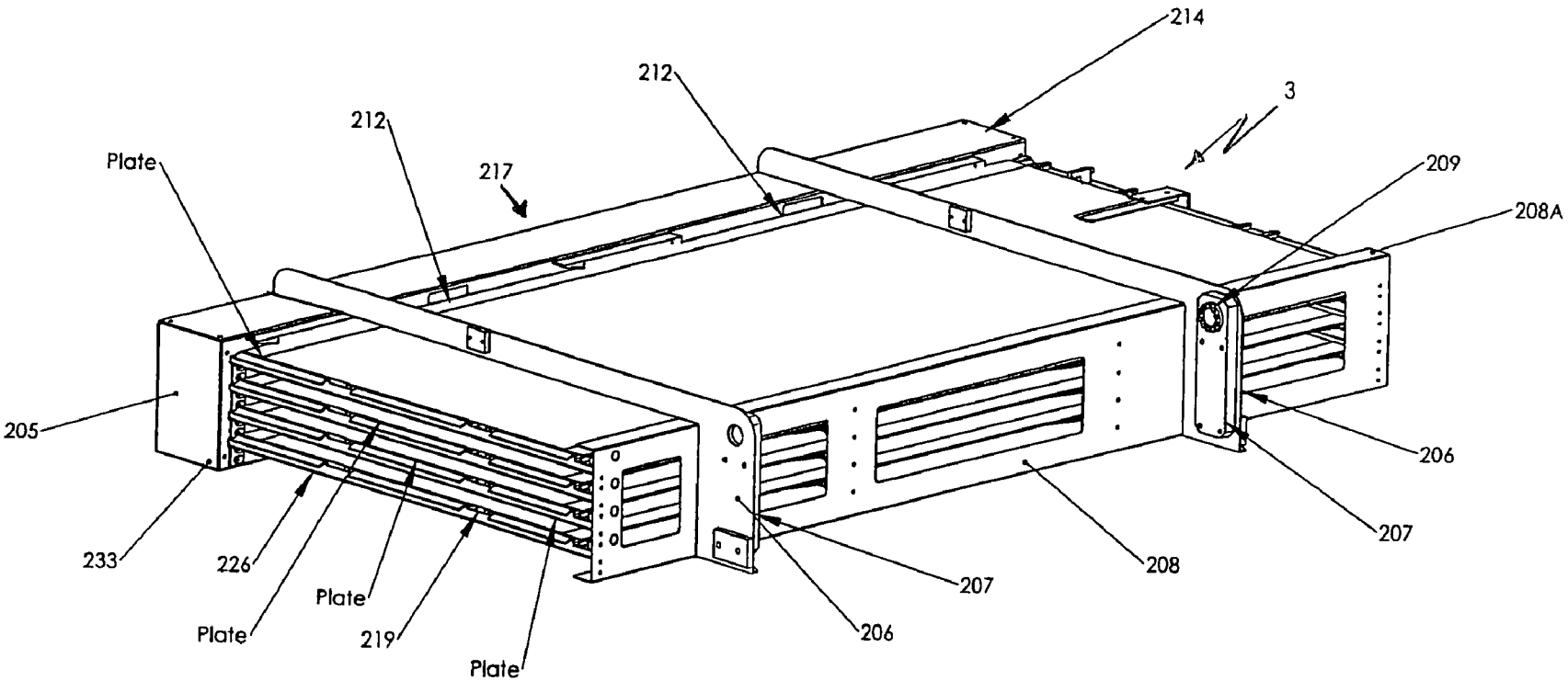
FIG. 9 is a perspective view of an embodiment of an upper pod, fully loaded with plates.

Indexer module 2 is part of an integrated group of devices for transporting, loading, ejecting, and orienting lithographic plates. Indexer 2 pushes plates into a container (a pod 3) in succession by moving a plate elevator incrementally as the plates are loaded into the pod by the pusher, resulting in plates being stacked in individual positions one above another as best seen in FIG. 9. The container or pod can be swiveled through an arc of 90 degrees.

Figure 2:
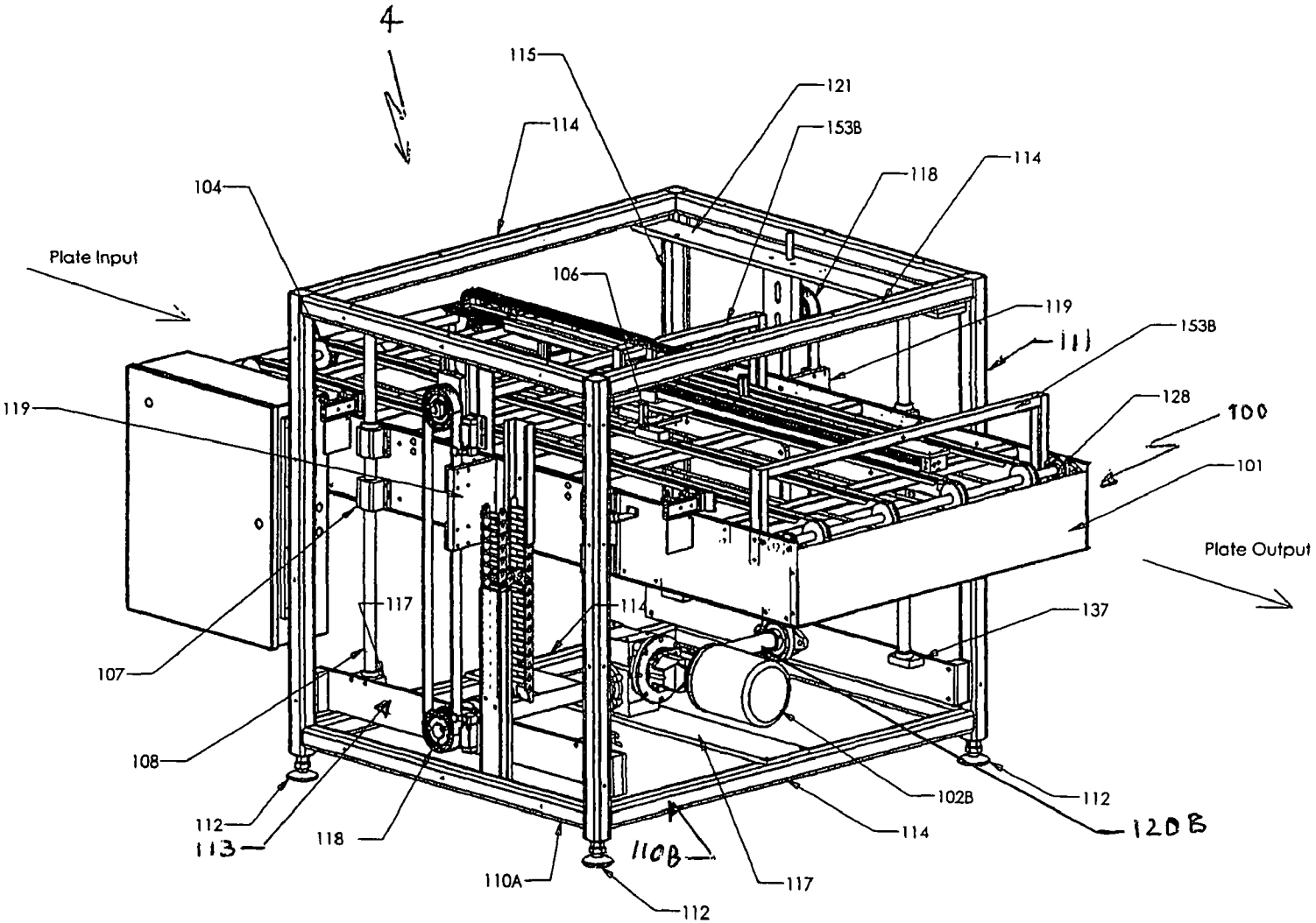
FIG. 2 is a perspective view of an embodiment of the indexer with its plate elevator in an up position.
Figure 3:
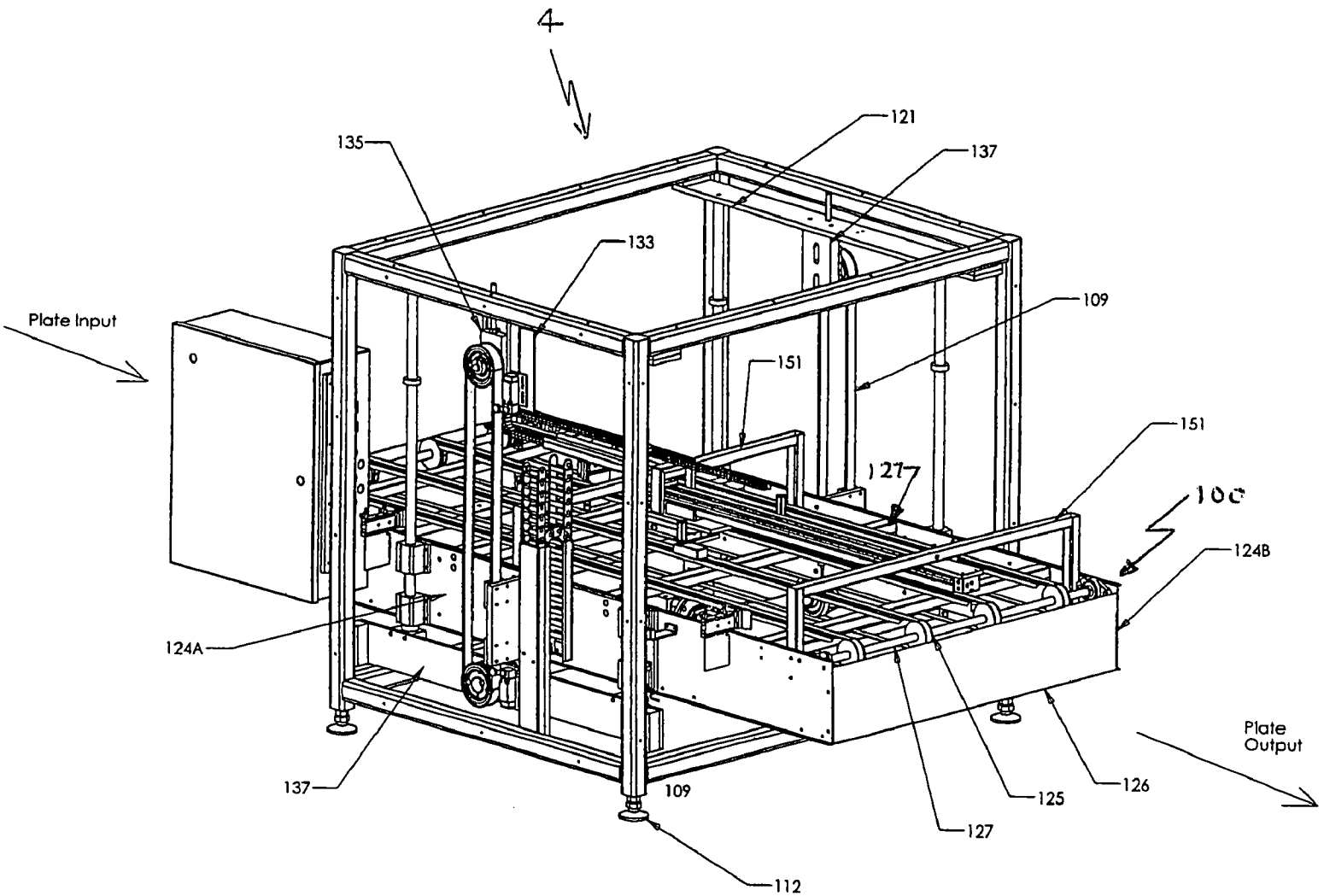
FIG. 3 is a perspective view of an embodiment of the indexer with its plate elevator in a down position.
Figure 6A:
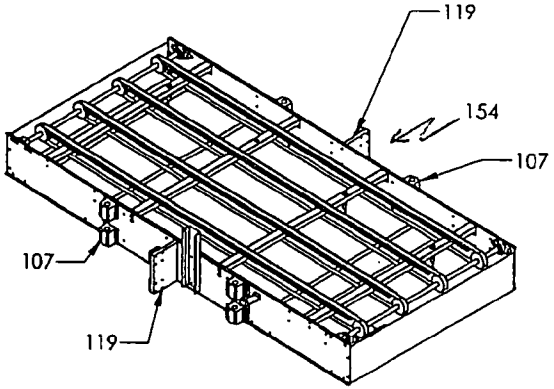
FIG. 6A is a perspective view of a conveyor module of an embodiment of the indexer of FIG. 1.

After the printing plates pass through bender 19 (such as that described in U.S. Pat. No. 5,970,774) to form bends at the edges of the plate, they are placed sequentially on a multi-directional transporter, a dual lift up conveyor, or a belt transporter 8 and transported horizontally for delivery to indexer 2. An embodiment of indexer 2 is shown in FIGS. 2-3. Plate indexer 2 receives the press-ready lithographic plates, one at a time, from belt transporter 8, which is configured in-line with indexer conveyor 154 (FIG. 6A). Indexer conveyor 154 is a loading module. It loads each of the plates in a pod 3 (or a cart pod 3*a*) designated by a PLC in the system for delivery to the press. The constructional features of pod 3 are shown in FIGS. 9-18. As mentioned, pod has several compartments that are separated from one another by parallel partitions 219, each of which is in separate vertically spaced positions.

As a plate begins to exit belt transporter 8, it enters indexer conveyor 101 (FIG. 2). A first sensor of indexer 2, senses the entry of the leading edge of incoming plate and automatically initiates forward movement of the belts of indexer conveyor 101. Indexer conveyor 101 operates at the same speed as does belt transporter conveyor 8. Indexer conveyor 101 moves the plate to a position proximate a second sensor, which stops further plate movement. At the point when the plate is stopped, the plate is fully loaded into indexer conveyor 101. Elevator motor 102, operating under control of the PLC system controller, moves the indexer conveyor 101 vertically so that it (with encoded information on the plate, such as a bar code) is in horizontal alignment with the bar coded plate's assigned pod compartment. A look-up table in the memory of the system controller PLC is pre-programmed with an index of all of the compartments of pod 3. The system controller associates each of the imprinted bar codes with a single one of the indexed compartments of each pod 3. Typically, each of the printing plates moving within the system is imprinted with a bar code during, for example, the plate's initial entry into the system. Each indexed compartment is at a pre-determined vertical position of indexer 2 and that position is stored in system controller. In one embodiment, there may be 16 compartments. Therefore, for example, if a plate with bar code AAA is loaded into indexer conveyor 101, the system controller PLC will sense the AAA bar code, associate it with the plate assigned to a particular compartment ($9^{th}$ compartment, for example), and signal elevator motor 102 to move the index conveyor up or down, as the case may be, to the $9^{th}$ compartment. The now vertically moving index conveyor acts as an elevator and will sense when it has reached the vertical location of the $9^{th}$ compartment by reference to the indexer's linear encoder, which senses conveyor/elevator's position, and will stop moving at the $9^{th}$ compartment. At this juncture, plate pusher finger assemblies 106 (for example, 2 opposing assemblies proximate each side of plate) orient the plate so it's alignment on the plate conveyor elevator is in alignment with its assigned pod compartment. The plate is then ready for interference free movement into the assigned pod compartment. At the pre-determined vertical position, the system controller PLC signals the conveyor feature of the indexer conveyor/elevator 101 to begin forward movement of plate into its assigned compartment. When the trailing edge of the plate is sensed by the second sensor, the system controller signals the plate assist assembly 151 (FIG. 7A) to push the trailing edge of the plate fully into its compartment. After insertion of the bar coded plate into pod 3, the system controller signals indexer conveyor/elevator motor 102 to return to the position associated with the belt transporter 8 level for receipt of another plate from the belt transporter 8. The indexer handles one plate at a time. After receipt of the plate, the indexer conveyor elevator again begins its stepwise vertical movement under control of motor 102 until it reaches the designated compartment for the next plate, at which point the conveyor/elevator stops. As described previously, the next plate is placed in its respective indexed compartment and so begins anew the next series of cycles until a pod is fully loaded.

Indexer 2 is configured so that the PLC system controller can pause the operation of indexer 2 and thereby stop movement of press-ready plates already in indexer 2. The system controller can also pause the operation of any conveyor 8 and thereby stop movement of any plate enroute to indexer 2. The system controller is programmed to direct indexer 2 and other modules in the system when, for example, other plates are on a trajectory to intersect press-ready plates already in indexer 2 or enroute on a conveyor 8 to indexer 2. In a highly configured system, the system controller may need to frequently control traffic due to multipathing of plates to multiple presses and the intersection of the multi-paths. The system controller thus acts like a stop and go light; stopping movement on some pathways while allowing movement on an intersecting pathway for higher priority plates for collisions avoidance.

Figure 4:
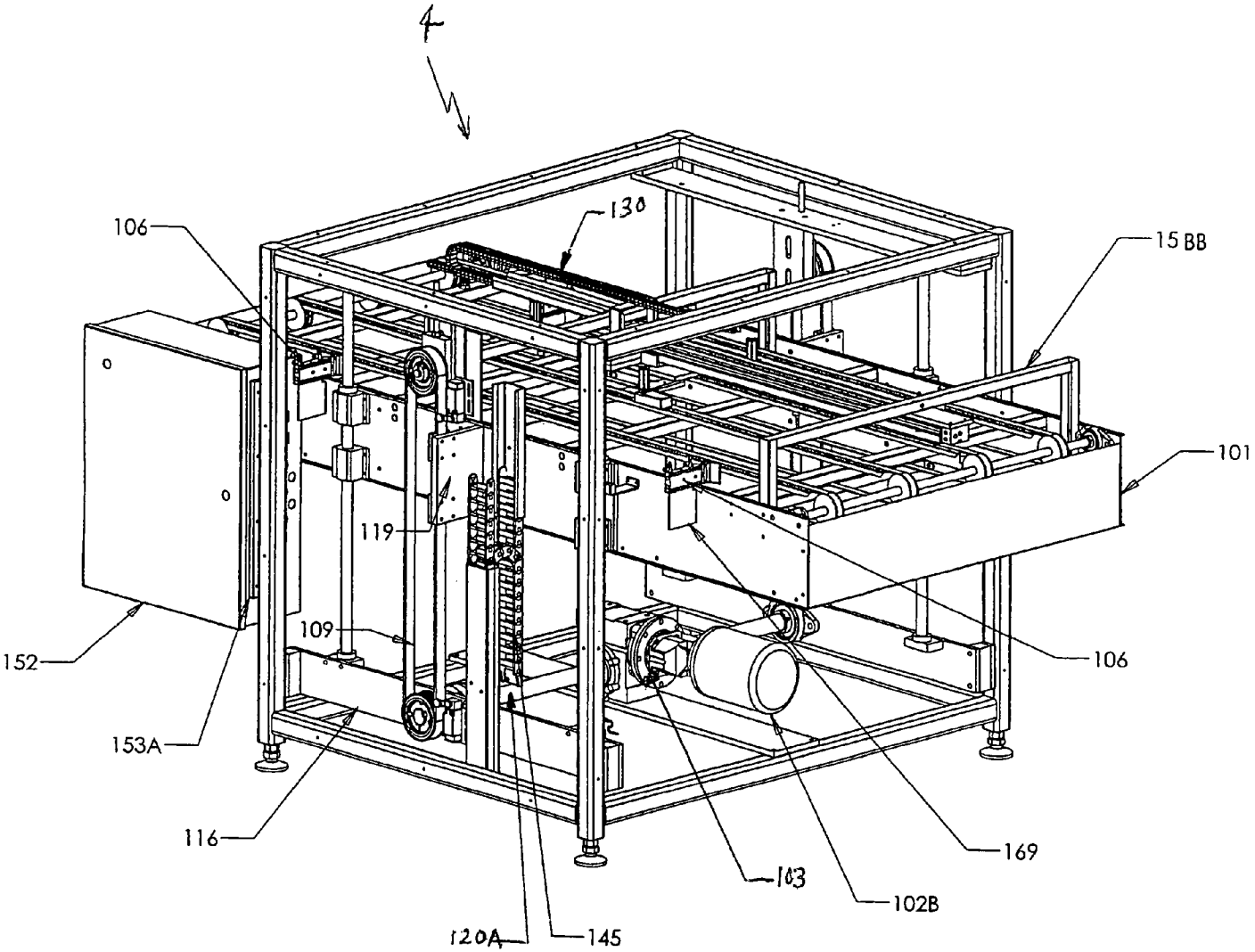
FIG. 4 is another perspective view of an embodiment of indexer with its plate elevator in an up position.

FIG. 2 is a perspective view of an embodiment of indexer 2 with its conveyor/elevator 100 in an up position. FIG. 3 is a perspective view of an embodiment of indexer 2 with its conveyor/elevator 100 in a down position. FIGS. 2-3 illustrate indexer 4 with its conveyor/elevator 100 in-line with side horizontal frame members 110A. FIG. 4 is also a perspective view of an embodiment of indexer 2 with its conveyor/elevator 100 in an up position.

Figure 8:
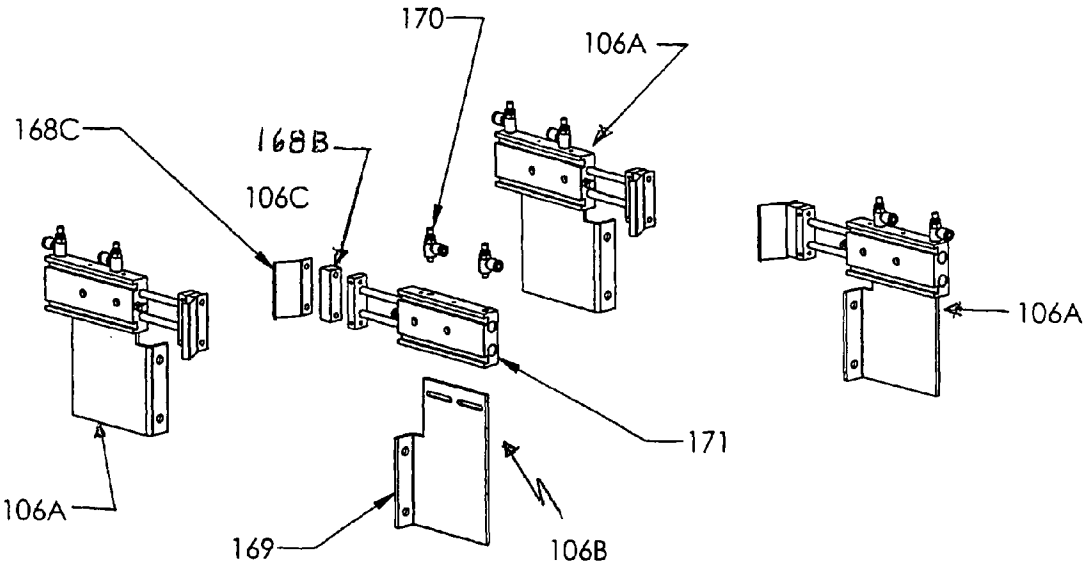
FIG. 8 is a perspective view of finger pusher assemblies used in an embodiment of the indexer.

Indexer 2 is comprised of frame 114, conveyor/elevator 100, elevator drive system 102B, indexer conveyor 101, plate centering assembly 105, and plate finger pusher assembly 106 (FIG. 8).

An embodiment of frame 114 is a box frame, as shown in FIGS. 2-3, with side horizontal frame members 110A, end horizontal frame members 110B, vertical frame members 111, and leveling pads 112. Leveling pads 112 are adjustable for leveling indexer 2. Horizontal and vertical frame members 110A, 110B, and 111 must be of an adequate size and have adequate strength to steadily support conveyor/elevator 100 and the other parts of frame 114 with little flexing. Tubular or square steel tubing is acceptable for this purpose.

Housing 113 is secured to frame 114. Housing 113 provides an internal frame for conveyor/elevator 100, elevator drive motor 102B, and worm gear box 103. Housing 113 comprises horizontal frame members 114, vertical frame members 111, side plates 116 (FIG. 4), and drive motor support 117 (FIG. 2).

Elevator 100 is movable vertically within frame 114 and housing 113. Elevator 100 is formed of lightweight side box beams 124A and end box beams 124B FIG. 3) with a plurality of spaced-apart parallel top cross members 127 extending laterally between parallel side box beams 124A for lateral strength. Elevator 100 can be in a down position to receive a lithographic plate and then raised to an elevated position for exiting the plate from indexer 2 into a selected compartment of pod 3 or plate rack 10 for delivery to the press. Alternatively, elevator 100 can be in an elevated position to receive a lithographic plate and then lowered to a down and/or up position for exiting the plate from indexer 2 into pod 3 or plate rack 10 for delivery to the press.

Figure 5:
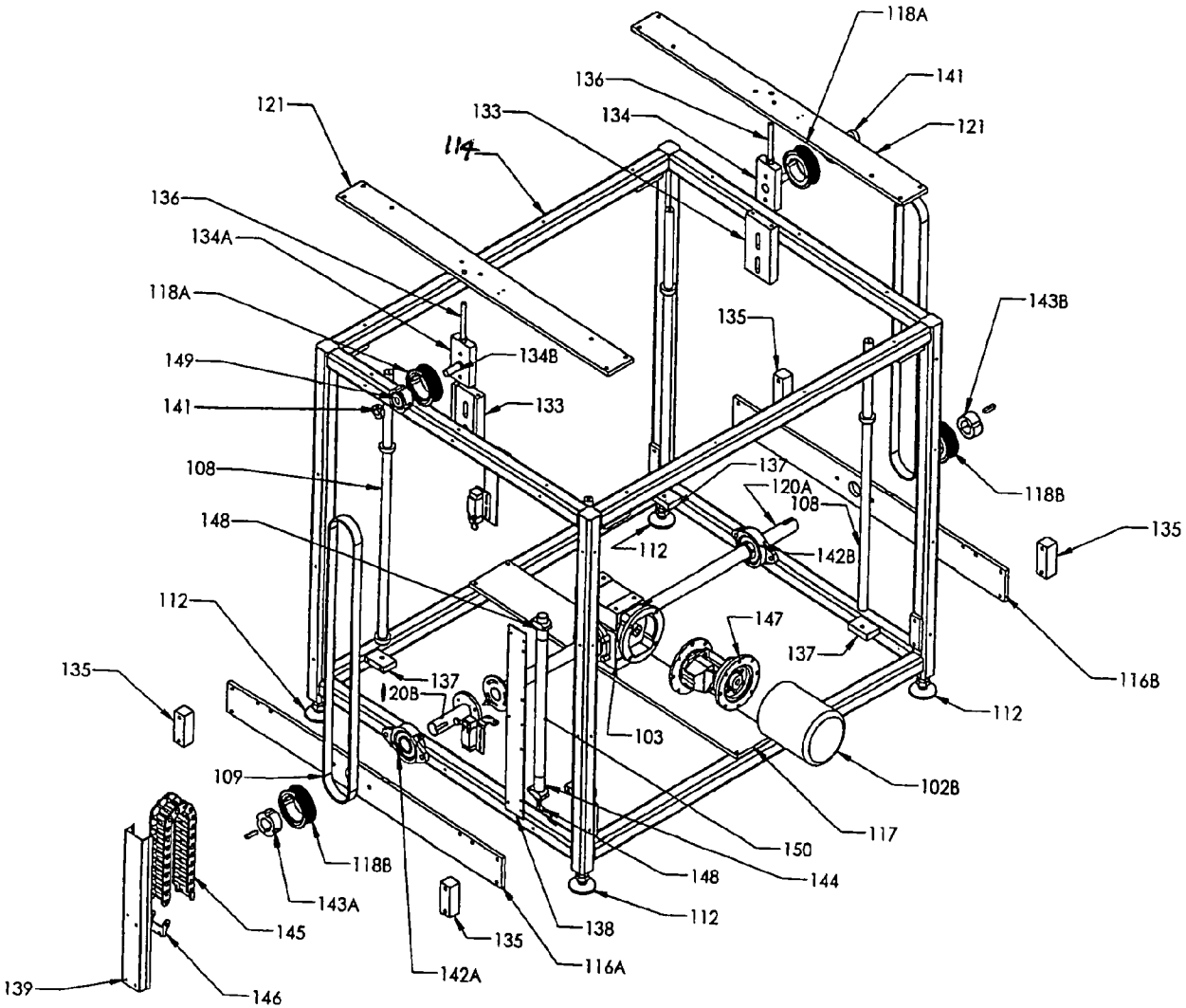
FIG. 5 is an exploded view of a portion of the embodiment of indexer illustrated in FIG. 4.

The elevator drive system raises and lowers elevator 100. As seen in FIG. 5, it is comprised of drive motor 102B, 4:1 helical adapter 147, worm gear box 103, drive shafts 120A and 120B, bearings 142A and 142B, side plates 116A and 116B, spacer plates 135A and 135B, taper lock adapters 143A and 143B, upper drive belt pulleys 118A, lower drive belt pulleys 118B, open drive belt 109, open drive belt clamp plate 119, open drive belt clamps 166, side plate 160, single split collar 141, taper lock idler 149, idler mount 134, take-up bolt 136, take-up mount 133, top plate 121, linear shafts 108, linear shaft mounting block 137, and linear bearings 107.

Drive motor 102B, an AC motor, is connected to 4:1 helical adapter 147, which reduces the drive motor's speed to ¼ its output rpm. The output of 4:1 helical adapter 147 is delivered to worm gear box 103 and then to drive shafts 120A and 120B. Drive shafts 120A and 120B run in bearings 142A and 142B. Bearings 142A and 142B are mounted on the backside of side plates 116A and 116B. Spacer plates 135A and 135B offset side plates 116A and 116B inwardly from frame 114 for clearance from outside of frame 114. Drive shafts 120A and 120B extend through an aperture in each side plate 116A and 116B and are engaged by taper lock adapters 143A and 143B, which are affixed inside lower drive belt pulleys 118B. Open drive belt 109 engages upper and lower drive belt pulleys 118A and 118B. Upper drive belt pulleys 118A include taper lock idlers 149 fixedly engaged within the hubs of upper drive belt pulley 118A. Shaft 134B of idler mount 134A rotatably extends through apertures in taper lock idlers 149 and are held in place by single split collars 141. Idler mounts 134A are held in place by take-up mounts 133, which are affixed to horizontal frame members 110 and to top plates 121. Top plates 121 are also affixed to horizontal frame members 110A. Take-up bolt 136 is adjustable to increase or decrease tension in open drive belts 109 and it extends through top plates 121 for easy access. The ends of open drive belt 109 attach to open drive belt clamp plate 119 and are clamped to open drive belt support 119 by open drive belt clamps 166. Open drive belt clamp plate 119 is attached to elevator 100. Motor drive shafts 120A and 120B protrude through side plates 116A and 116B and connect with their respective upper and lower drive belt pulleys 118A and 118B. Side plates 116A and 116B are attached to vertical housing members 115 at the bottom of the vertical housing members. Each linear shaft 108 is fixed at its ends within a mounting block 137, so that it neither rotates or moves vertically. Linear bearings 107 are attached to elevator 100. Each linear shaft 108 rides within two linear bearings 107 allowing elevator 100 to move smoothly in a vertical direction. Upper drive belt pulleys 118A and 118B are indirectly attached to upper horizontal housing members 114. Elevator drive motor 102 is seated on drive motor support 117 and fastened to horizontal frame member 114. Motor drive shafts 120A and 120B extend from each side of elevator gear drive box 103 and extend through side plates 116A and 116B and into lower drive belt pulleys 118A and 118B on each side of indexer 2. Elevator drive motor 102B is configured with 60:1 speed reducer 147 for transmission of power from its armature, which is contained in drive motor 102B housing.

Figure 6B:
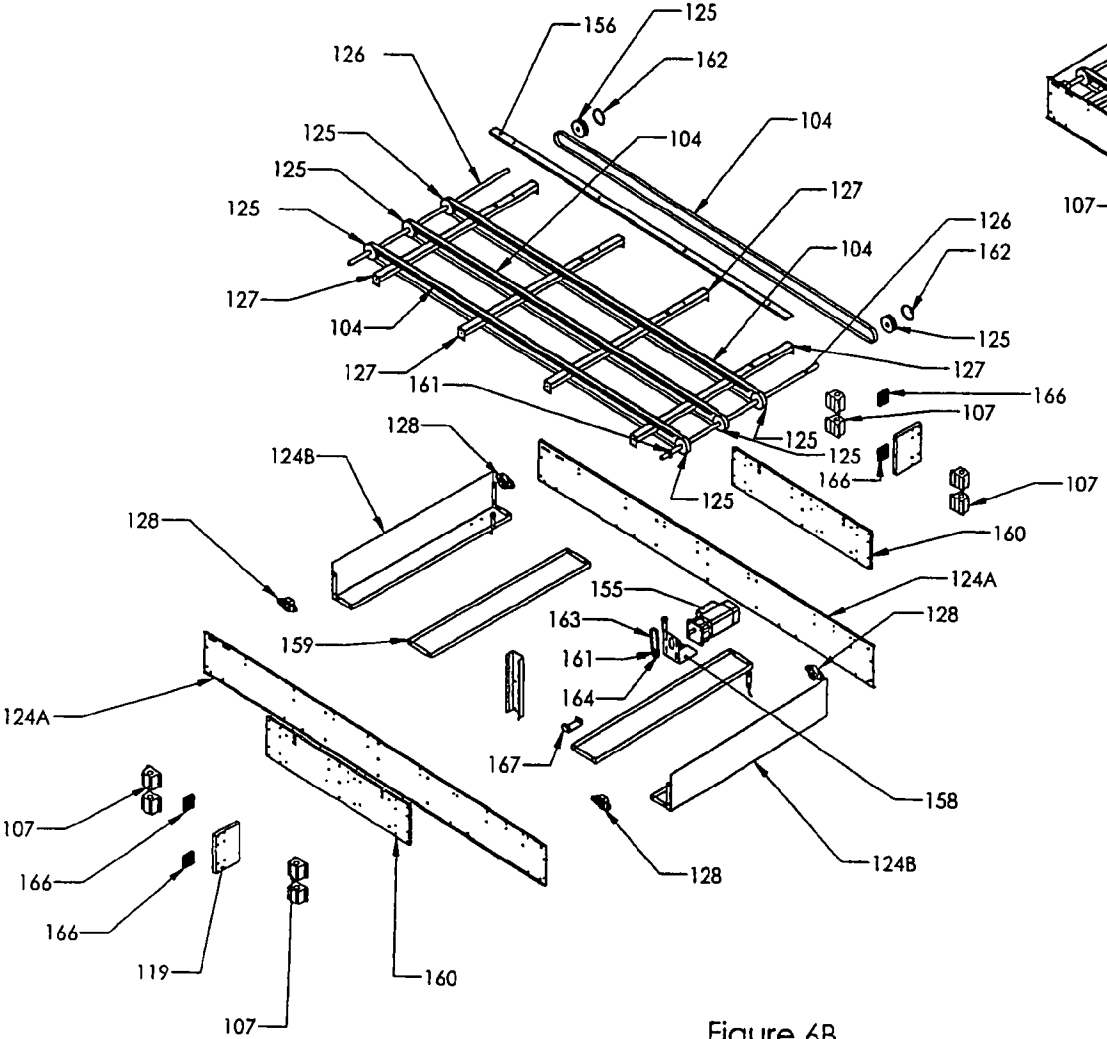
FIG. 6B is an exploded view of the conveyor module of an embodiment of indexer of FIG. 1.

FIGS. 6A-6B best illustrate indexer conveyor 154 of conveyor/elevator 100. A series of web pulleys 125 are affixed to drive shafts 126. The ends of each drive shaft 126 are rotatably affixed into bearings 128. Bearings 128 are affixed to side box beams 124A parallel to top cross members 127 near end box beams 124B. The two web pulley 125/drive shaft 126 combinations are mounted near each end box beams 124B and in parallel to each, so flat web belts 104 can be rollably affixed to in-line web pulleys 125 near each end box beam 124B. Flat web belts 104 move around web pulleys 125 in parallel with side box beams 124A and other web pulleys 125. Web pulleys 125 move longitudinally by chain drive 130 connected to sprockets 131 on drive shafts 126. Chain drive 130 is driven by an electric motor (not shown).

Plate centering assembly 155 (FIG. 6B) is mounted perpendicular to side box beams 124A. It may be comprised of a pneumatic or electrical actuator assembly. The push rod of a pneumatic actuator moves the lithographic plate laterally after it enters onto conveyor/elevator 100. In one embodiment, there are four plate centering assemblies 105. The number of plate centering assemblies depends to some extent upon the size of the plate. Smaller plates may be centered by two or three such assemblies. Indexer 2 is programmed so that each of the plate centering assemblies 105 work in conjunction with one another to move the plate in a lateral registration position. After the plate has entered indexer 2, plate finger pusher assembly 106 (FIG. 4) adjusts the position of a plate on bed conveyor 132 of conveyor/elevator 100 to be in registration with the bed. The registration position on the bed is established so that when the plate begins to be ejected from indexer 2 it will travel in a pre-set direction within the ambit of a defined path that is in-line with the entry point of a designated compartment of pod 3. If the plate is not in registration, it may jam within indexer 2 or with pod 3 as it is ejected from indexer 2.

Plate finger pusher assemblies 106A and B are best illustrated in FIG. 8. FIG. 8 is a perspective view of assemblies 106A, of which there are three, and is an exploded view of assembly 106B, of which there is one. Assemblies 106A and 106B are identical to one another. Two assemblies 106 are mounted on each side of the lithographic plate and move the plate for proper positioning on the bed of indexer 2. Assembly 106 is comprised of dual rod cylinder 171, finger spring 168A, finger spring block 168B, cylinder bracket 169, and flow control fitting 170. Two finger pusher assemblies 106 are attached to each side box beam 124 of elevator 101 by cylinder bracket 169, as shown in FIG. 4. Dual rod cylinder 171 is operated pneumatically. Flow control fitting 170 has a port, the size of which is manually adjustable by a port handle to decrease or increase the amount of air entering the cylinder and thereby driving the movement of the cylinder. Too much air may over-drive the rod and damage the plate. Too little may not move the plate into position. Finger spring 168A is a compliance spring. It is attached to block 168B. It introduces some give or resiliency when it connects with the plate so the plate will not be damaged. V-portion 168C is the contact point with the plate.

Figure 7A:
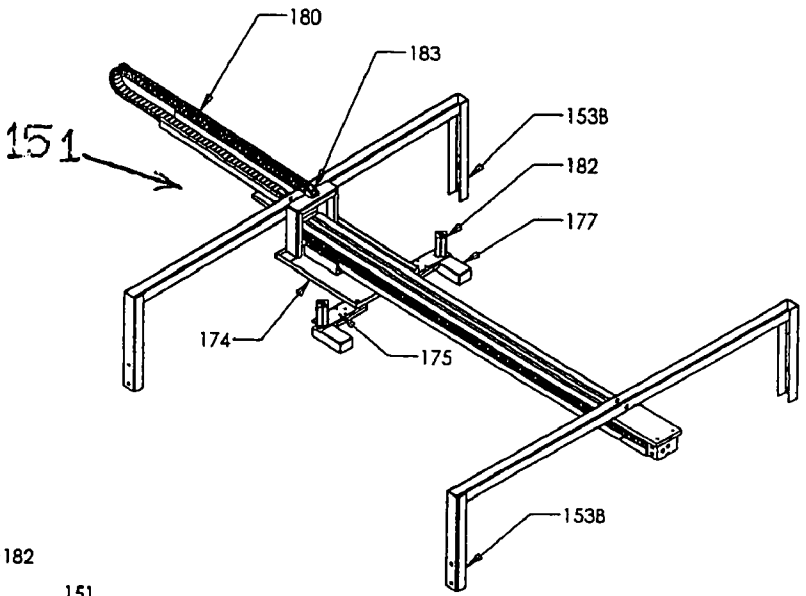
FIG. 7A is a perspective view of plate assist assembly of an embodiment of the indexer.
Figure 7B:
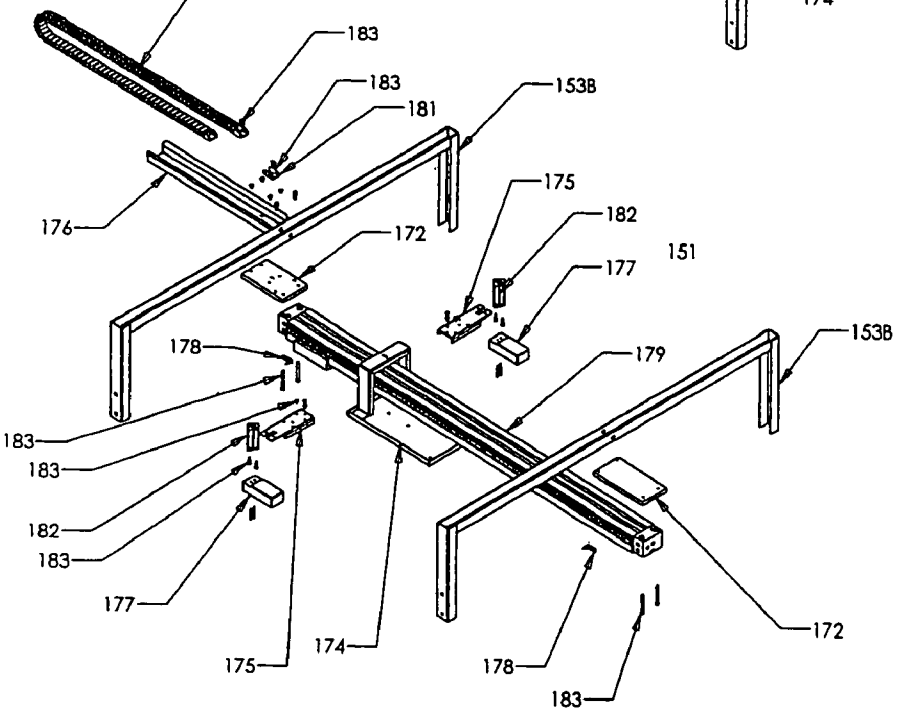
FIG. 7B is an exploded view of a plate assist assembly employed in an embodiment of the indexer.

Plate assist assembly 151 is illustrated in FIGS. 7A-7B. When the trailing edge of a plate is sensed by second sensor 185, the system controller not shown signals plate assist assembly 151 to push the trailing edge of the plate fully into its compartment 200. Plate assist assembly 151 is mounted over the top of indexer conveyor/elevator 101. Plate assist mounts 153B are mounted between side box beams 124A on elevator 100. A rear plate assist mount 153B is mounted proximate the plate exit point of indexer conveyor/elevator 101 and the front plate assist mount 153B is mounted proximate the center of indexer conveyor/elevator 101. Rodless cylinder mounts 172 are affixed on plate assist mounts 153B at the center-line of each mount 153B and rodless cylinder 179 is mounted to rodless cylinder mounts 172. Rodless cylinder 179 is mounted in a direction parallel to movement of flat web belts 104 on indexer conveyor bed 154. Base cylinder mount 174 is affixed to rodless cylinder 179 and slides forward from its position near centrally disposed front plate assist mount 153B when the system controller signals it to push a plate into its respective compartment 200. A pusher assembly is mounted to base mount cylinder 174 at its leading edge when pushing a plate. The pusher assembly is comprised of two pusher blocks 177, respective cylinders 182, respective cylinder mounts 175. When base cylinder mount 174 moves a plate into compartment 200, it passively pulls electrical conduit chain 180 with it. When base cylinder mount 174 completes its task of pushing a plate into compartment 200, electrical conduit chain 180 deliveries the signal to rodless cylinder 179 to return to home at its start position in readiness for pushing the next plate. Electrical conduit chain 180 is supported by chain guide 176. Electrical conduit chain 180 is connected at one end to the top of base cylinder mount 174 and at the other end to the bottom of chain guide 176. Each end is connected to their respective locations by small brackets 181.

Pod

As will be illustrated with respect to an embodiment of pod elevator 4 described infra, pod elevator 4 has two pods which are integral parts of pod elevator 4.

Pod 3 of FIG. 1 is more particularly shown in FIGS. 9-18 and comprises a container that receives bar coded plates from indexer 2 (the pod loading machine) and loads the pod with the plates. The plates are loaded in a horizontal position. Pod 3 is then transported to a station in close proximity to a printing press. A press person extracts each plate from the pod, one by one, and locks-down each plate on the selected press cylinder. Pod 3 has several compartments 200 that are separated from one another by parallel partitions 201 (consisting primarily of rails 219, see in FIG. 11), each of which are in separate vertically spaced positions. Indexer 2 loads the bar coded plates into the various compartments 200 of pod 3, as designated by the system's PLC, in succession by moving indexer elevator 100 incrementally up or down until it is in horizontal alignment with the bar coded plate's assigned pod compartment 200, resulting in plates being stacked in individual compartments 200, one above another. In one embodiment of pod 3, there are 16 compartments 200.

Pod 3 can be integrated with a pod elevator 4 shown in FIGS. 19-23 for movement of the plates stored in pod 3 to the press. Pod 3 is in a horizontal position in pod elevator 4 after it is loaded with plates. The pod can then be swiveled through an arc of 90° to bring it into a vertical position within the pod elevator 4 for vertical movement by the pod elevator 4. The plates ride within pod 3 in an upright-vertical position, suspended by a bend along one edge of the plate, the bend having been made by punch/bender 19. Vertically hung pod 3 is transported (lowered or raised, as the case may be) by pod elevator 4 to a station where the plates contained therein will be manually removed and loaded onto a designated press cylinder by a press operator, according to each plate's bar coded information.

Each parallel compartment 200 of pod 3 is provided with a plate hanger 202. Plate hangar 202 is designed to enable the relatively fragile plates to be rotated 90° from their horizontal positions to vertical positions without damage to the plates and image thereon. After rotation, the plates are automatically suspended on hangers 202 (FIG. 17) in vertical positions. Hangers may be made of a plastic material for avoidance of plate scratching. Hanger 202 is affixed longitudinally to enclosure base 223. Hanger 202 is comprised of a top bracket 202A connected to an angled bracket 202B. Top bracket 202A is in-parallel with the bottom surface of the plate and the bottom surface of the plate rests on top bracket 202A. Projecting downward from top bracket 202A and from the bottom surface of the plate is angled bracket 202B. Angled bracket 202B projects downward at an angle that is over 90° from top bracket 202A to form an anvil shaped hanger assembly 202. The bend formed along one edge of the plate is tucked around the point where the top bracket 202A and the angled bracket 202B meet, thereby hooking the anvil shaped bend on the edge of the plate over hanger 202.

Figure 10:
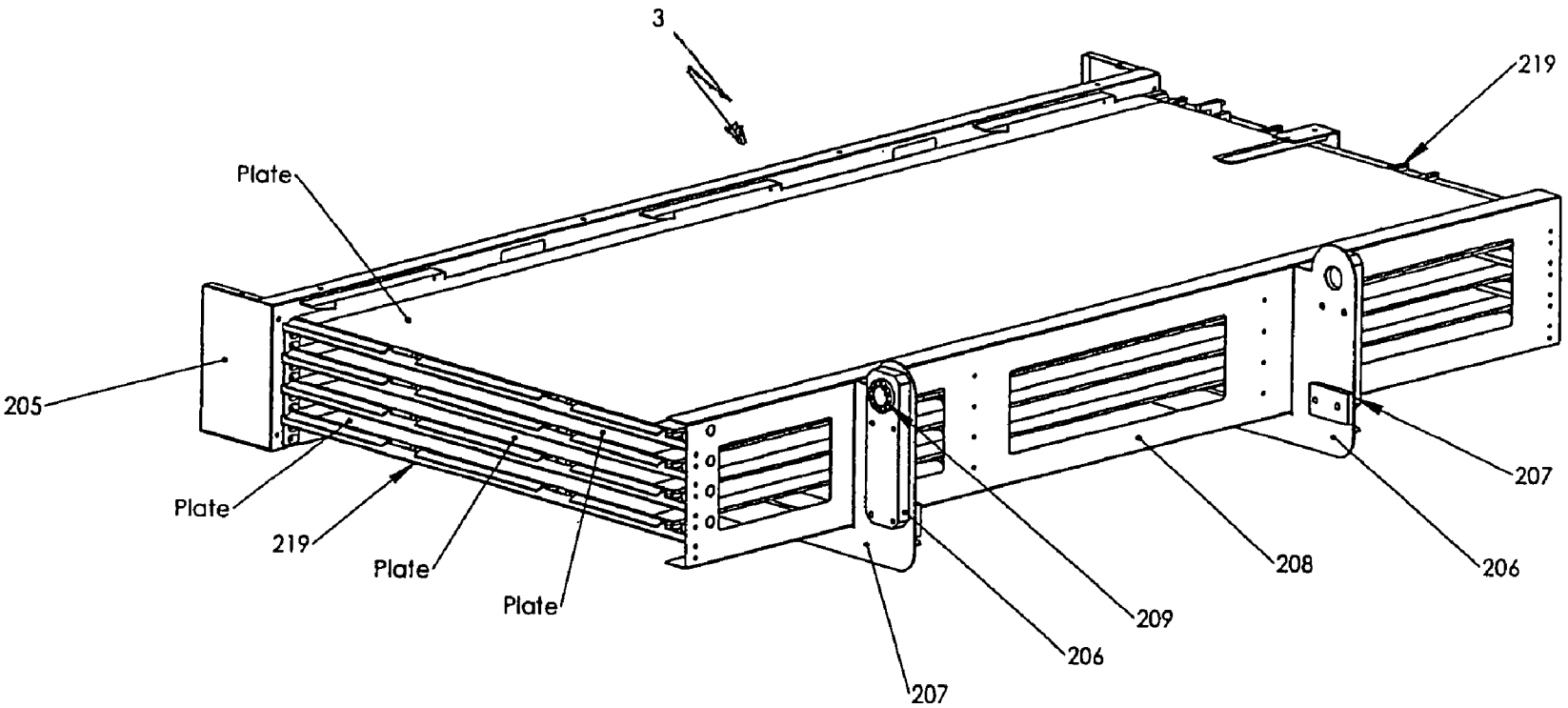
FIG. 10 is a perspective view of an embodiment of a lower pod, fully loaded with plates.
Figure 11:
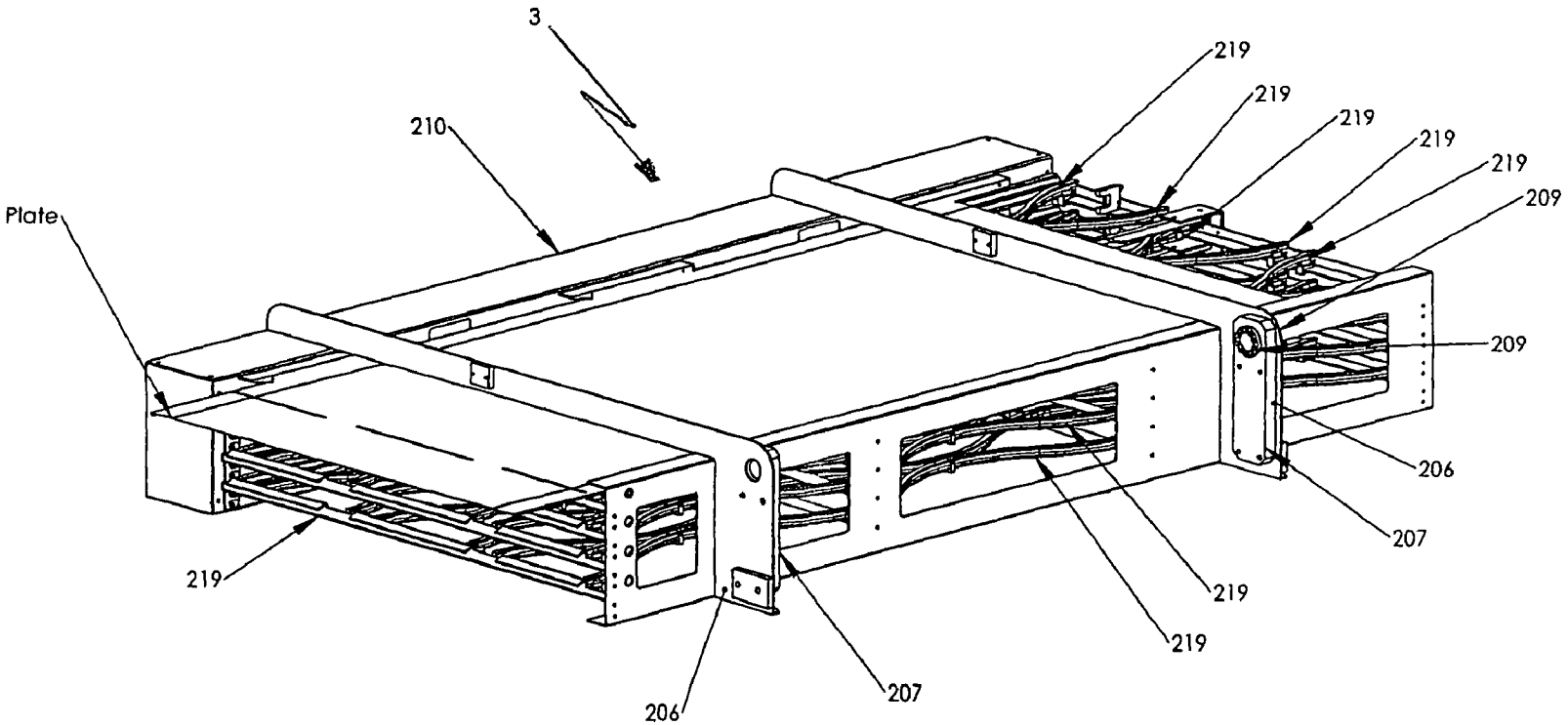
FIG. 11 is a perspective view of an embodiment of the upper pod with one partially loaded plate.
Figure 12:
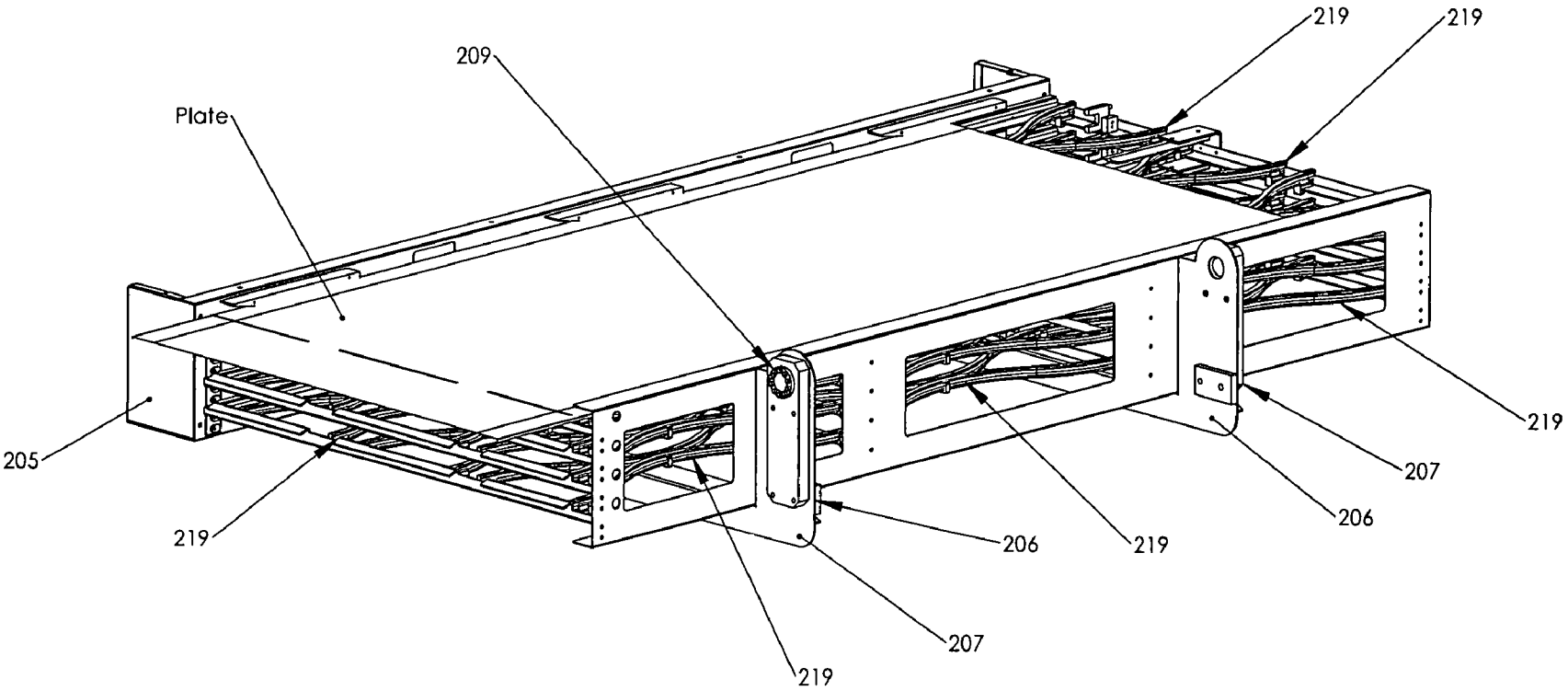
FIG. 12 is a perspective view of an embodiment of the lower pod with one partially loaded plate.

FIG. 9 is a perspective view of an embodiment of upper pod 3, fully loaded with plates. FIG. 10 is a perspective view of an embodiment of lower pod 3, fully loaded with plates. FIG. 11 is a perspective view of an embodiment of upper pod 3 with one partially loaded plate. FIG. 12 is a perspective view of an embodiment of lower pod 3 with one partially loaded plate extending outward from a front end portion of the pod. Enclosure 217 (FIG. 9) is comprised of base 233, cover 214, and two end caps 205. Opposite enclosure 217 is channel shaped retainer 208 (FIG. 10). Enclosure and channel shaped retainer are tied together by a support member 226 affixed from a first end of enclosure 217 to a first end of channel shaped retainer 208. Another support member 226 is affixed in the same manner between the second end of enclosure 217 and the second end of channel shaped retainer 208. Two L-shaped supports 206 extend, in parallel, across the top of pod 3 and provide rigid transverse bracing between enclosure 217 and channel shaped retainer 208. L-shaped supports 206 are respectively affixed at their ends to enclosure cover 214 and to the top of channel shaped retainer 208A and to the face of channel shaped retainer 208B. A plurality of curvilinear rails 219 are connected between support members 226 at both ends of pod 3. Curvilinear rails 219 support the lithographic plates and form the partitions 201 between the compartments 200 of the pod. Each compartment 200 comprises a separate envelope for a separate plate.

Facing mounting blocks 207 are affixed to those portions of L-shaped supports 206 that are in contact with channel shaped retainer 208. Mounting blocks 207 provide rigidity to that portion of the L-shaped supports 206. Mounting blocks 207 also include keyless hubs 209 with apertures for insertion of pivot shaft 310 between opposing keyless hubs 209. As will later be explained, pivot shaft 310 is used by a pod elevator 4 to vertically move pod 3.

Two dual rod cylinders 212 (FIG. 9) are mounted in enclosure 217. Both cylinders 212 act to gently push the plate towards channel shaped retainer 208 and bring the apex of the anvil shaped bend of the plate in mating contact with the apex of anvil shaped hanger 202A. The effect is that the plate is held firmly in place in pod 3 during movement of the pod and damage to the plate is virtually eliminated.

Figure 13:
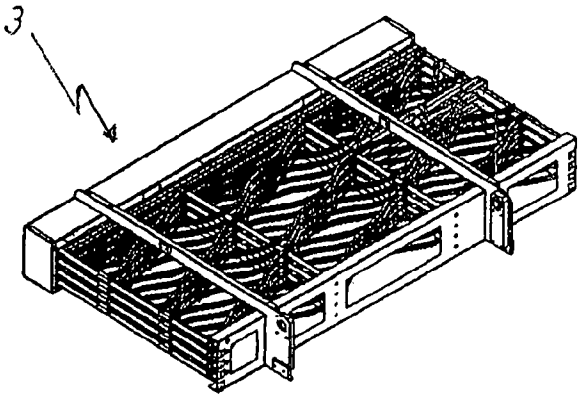
FIG. 13 is a perspective view of an embodiment of the upper pod shown without any plates loaded.
Figure 14:
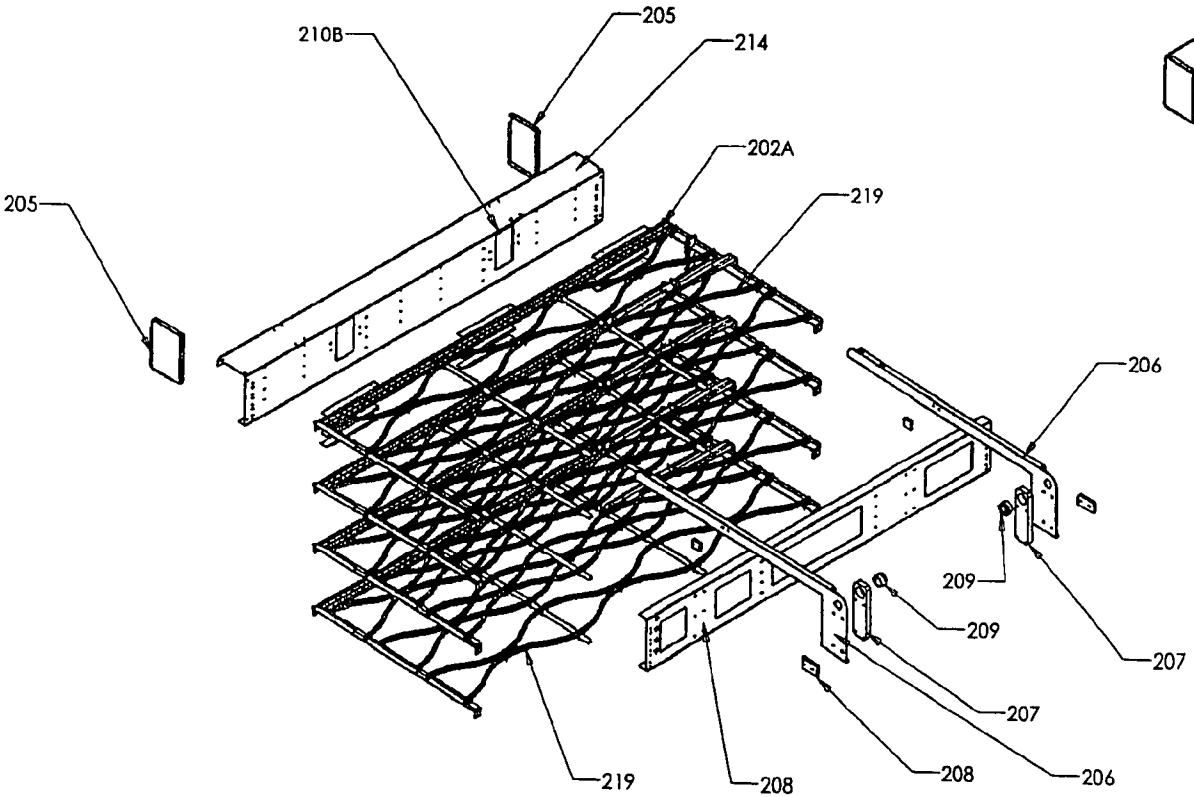
FIG. 14 is an exploded view of an embodiment of the upper pod.
Figure 15:
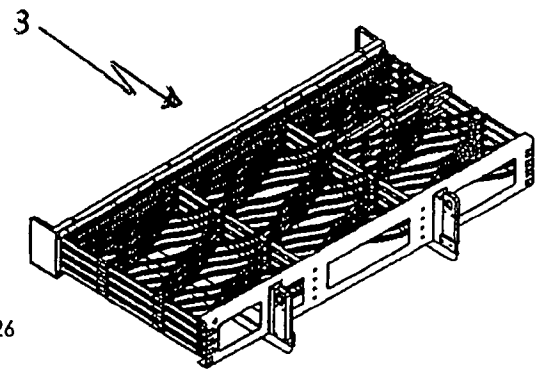
FIG. 15 is a perspective view of an embodiment of the lower pod without any plates loaded.
Figure 16:
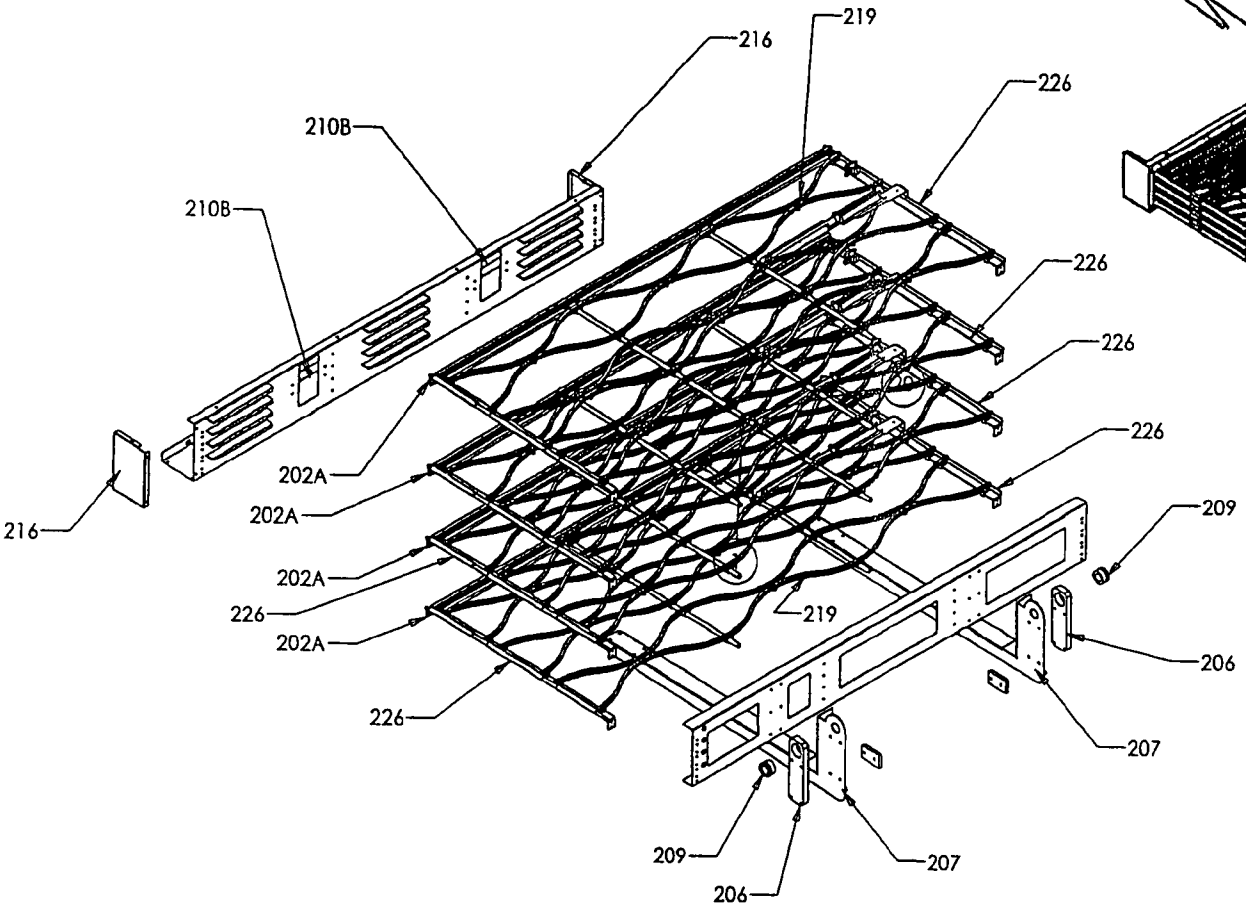
FIG. 16 is an exploded view of an embodiment of the lower pod.

FIG. 13 is a perspective view of an embodiment of upper pod 3 without any plates loaded. FIG. 14 is an exploded view of an embodiment of upper pod 3. FIG. 15 is a perspective view of an embodiment of lower pod 3 without any plates loaded. FIG. 16 is an exploded view of an embodiment of lower pod 3.

Figure 17:
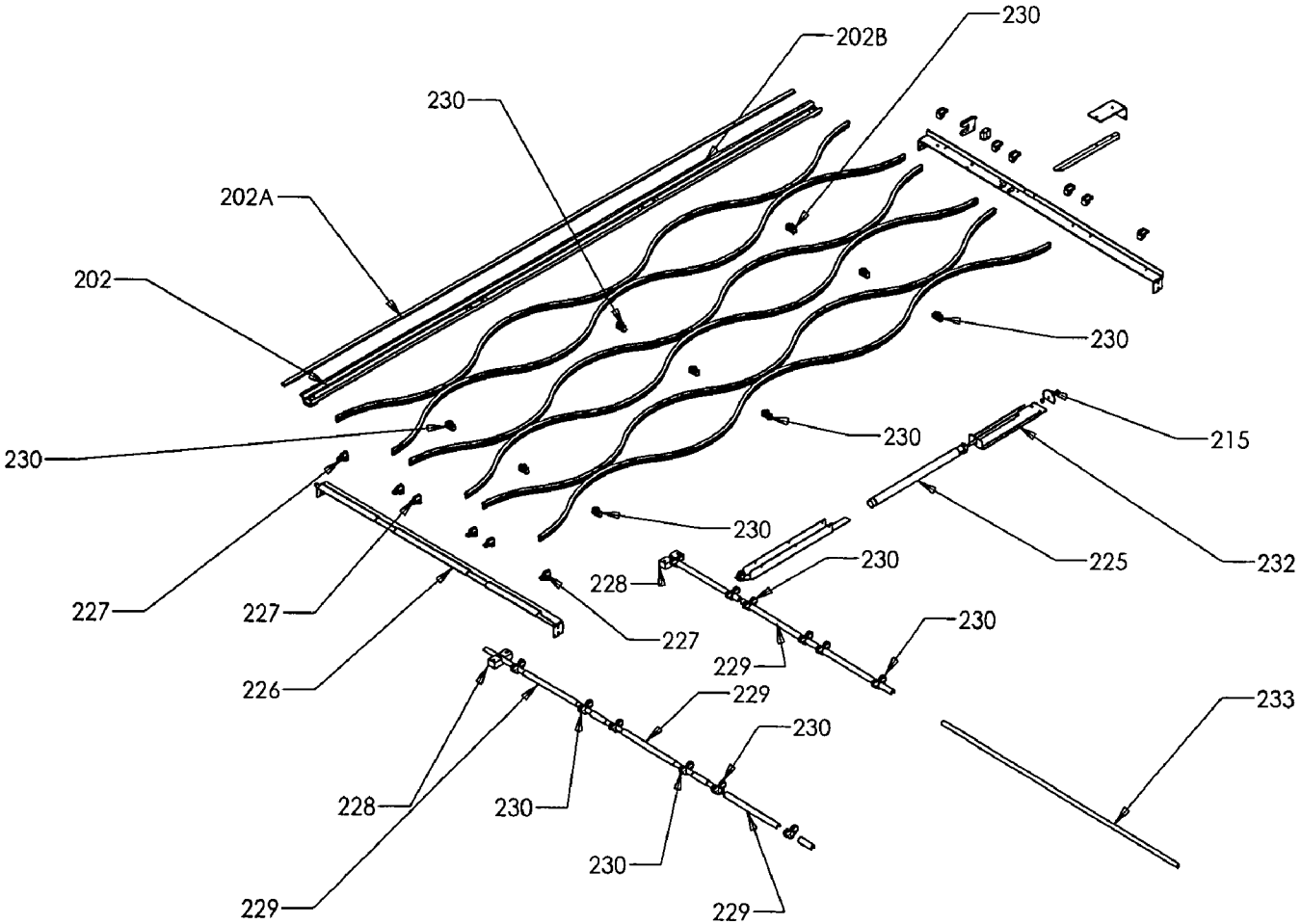
FIG. 17 is an exploded view of an embodiment of the upper pod partition and ejector.
Figure 18:
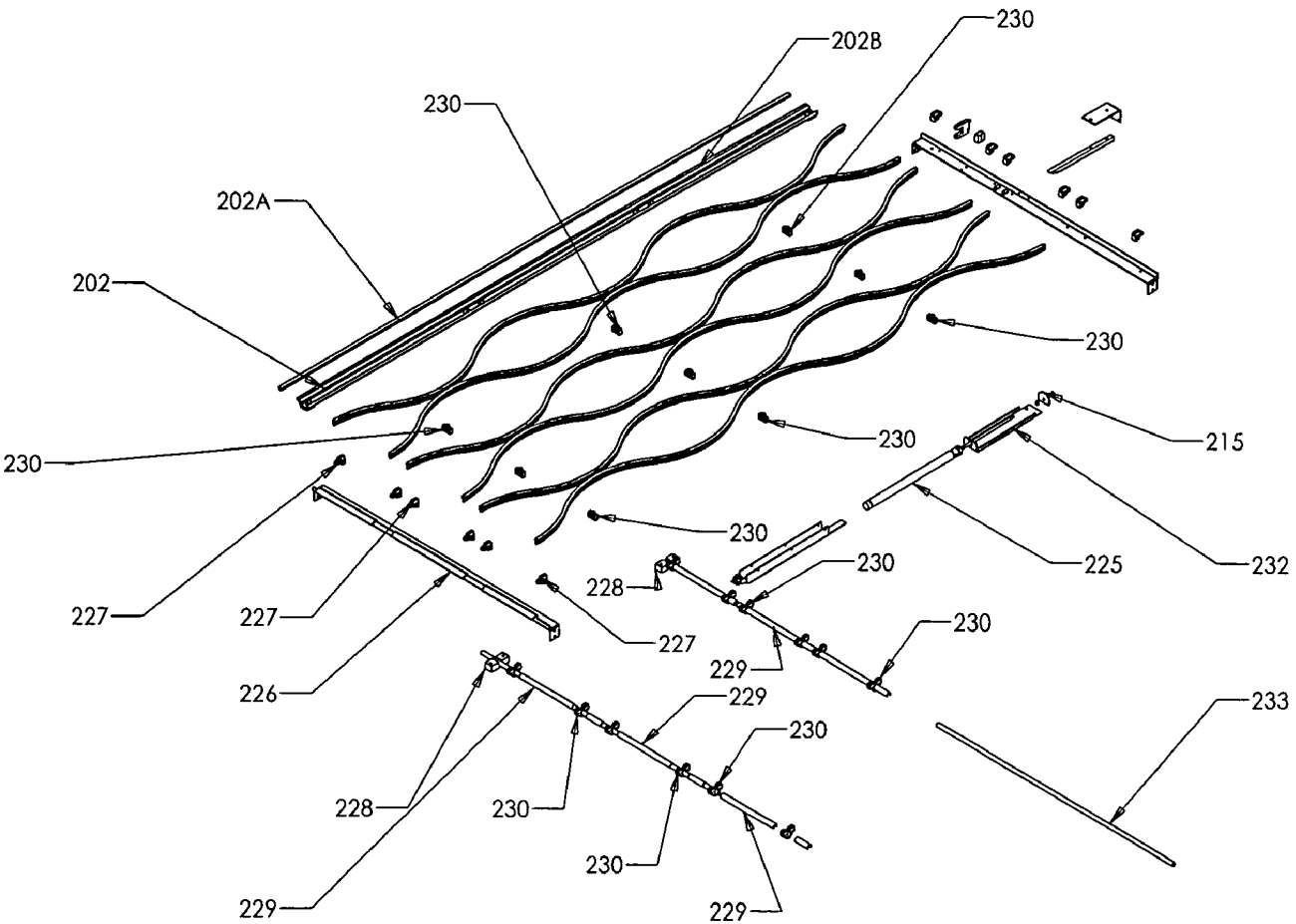
FIG. 18 is an exploded view of an embodiment of the lower pod partition and ejector.

FIG. 17 is an exploded view of an embodiment of the partition and ejector of upper pod 3. FIG. 18 is an exploded view of an embodiment of the partition and ejector of lower pod 3. Partition 201 is comprised of six curvi-linear rails 219. The rails 219 are connected to transverse rail supports 226 at the first and second ends of pod 3 with snap lock clips 227. Snap lock clips 227 are fastened to rail supports 226 and the ends of rails 219 are snapped into the top of snap lock clips 227. As shown in the figures, pinch lock clips 230 hold rails 219 together in pairs at the point where rails 219 abut one another. Support shaft 233 extends transversely across rails 219. Pinch lock clips 230 are spaced on shaft 233 so each clip 230 locks onto a single rail 219 where rails 219 abut one another. The spacing is shown in FIGS. 17-18. Spacing is maintained by round spacers 229 lying in between the spacers on support shaft 233. As shown in the figures, there are three such support shafts 233 supporting each of the partitions. However, there can be more or fewer shafts depending upon the length of the rails/partitions. A T-clamp 228 is attached to hanger 202 at the end of support shaft 233 and tied into channel shaped retainer 208 (FIG. 14). The top of hanger 202 is in the same plane as the top of rails 219.

A plate ejector 215 (FIG. 17) is comprised of a single rod cylinder 225 and mounting bracket 232. The cylinder is mounted on mounting bracket 232 and the bracket is affixed to support member 226 on the second end of each pod compartment 200. Ejection cylinder 215 extends in a direction from the second end of each pod compartment 200 to the first end of each pod compartment 200. As the ejection cylinder 215 is extended it ejects the plate from its compartment towards the second end of pod 3, one at a time, into the hands of a printer who will place the plate on the press cylinder. Plate ejector cylinder 215 retracts its piston 225 upon reaching its maximum travel point. To eject the plates, the printer signals the system controller to open a pod door. When the pod door opens, plate ejector 215 associated with a designated compartment 200 dispenses the plate from that compartment into the hands of the printer.

Pod elevator 4 can be scaled up or down to move more or less than two pods 3. The basic configuration of pod elevator 4 is the same regardless of pod capacity, except that the size of elevator 4 is scaled up or down (in for example, its height, pod capacity, or the size of the lithographic plate) to meet the needs of a customer's pre-press configuration.

Cart Pod

The cart pod (not shown) serves a similar function as does the previously described pod, albeit in a less automated manner. Primarily the cart pod is less automated because it cannot interface with the pod elevator and it is generally a wheeled device. It does however fully interface with the indexer and is loaded by the indexer in the same manner the indexer loads the pod. Once it is loaded with plates it is transported proximate the press cylinder, where the plates are unloaded and locked-up on a press cylinder. The cart pod is configured to be loaded with plates one at a time by the indexer. The configuration includes dimensional attributes that allows the cart pod to be in alignment with the pusher end of the indexer as if it were a pod. In this manner the pusher end of the indexer is in-line compatible with the cart pod. Moreover, the cart pod is configured to accept the same size plates as does the pod. The pusher assembly of the indexer pushes the plate into the cart pod in the same manner as it does with the pod. The cart pod also has separate vertically spaced compartments as does the pod. The indexer pushes plates into the separate cart pod compartments in succession by lowering the plates relative to the compartments incrementally as the plates are loaded by the pusher assembly, whereby the plates become stacked in individual positions one above another. Parallel partitions separate the cart pod into pod compartments. The elevator moves a plate in a vertical direction into horizontal alignment with the cart pod compartment that corresponds to a code on the plate. The compartments are indexed at a pre-determined vertical position of the indexer. A linear encoder senses the point at which the elevator has reached a specified vertical location corresponding to the assigned cart pod compartment, at which point the elevator stops. Pusher finger assemblies proximate each side of the plate align the plate with the elevator and the assigned cart pod compartment. Upon completion of alignment of the plate with the elevator and assigned cart pod compartment the indexer conveyor initiates forward movement of the plate into the assigned cart pod compartment and upon sensing the trailing edge of the plate by the second indexer sensor means, a plate assist assembly pushes the trailing edge fully into the assigned cart pod compartment.

Pod Elevator

The structure of pod elevator 4 is described, followed by the description of its operation.

FIG. 19 best illustrates the frame of pod elevator 4. The frame is comprised of multiple frame members 300, 300A, 300B and 300C. These frame members form the skeleton of pod elevator 4. Pod elevator 4 is most often mounted to a wall by mounting pads 304. To assure stability, pod elevator 4 is also floor-mounted by, for example, bolting the elevator into the floor through mounting frame members 300A. The top and bottom portions of elevator 4 are bolted together through top assembly pad 305A, located at the end of back frame member 300B of the top portion, and through a bottom assembly pad, located at the end of back frame member 300B of the bottom portion. The bottom portion of elevator 4 also has two front, upward extending legs 300C, each with an assembly pad which are bolted together. The top portion of elevator 4 is cantilevered over the bottom portion. The bottom portion of elevator 4 is sized to fit through an opening provided in a first floor ceiling of a two-story building. The cantilevered top portion is above the ceiling and bolted to the bottom portion of elevator 4. The top portion has a larger footprint than that of the bottom portion. Diagonal stabilizers 303 strengthen elevator frame members 300 and act as sway bracing, among other things.

Figure 24:
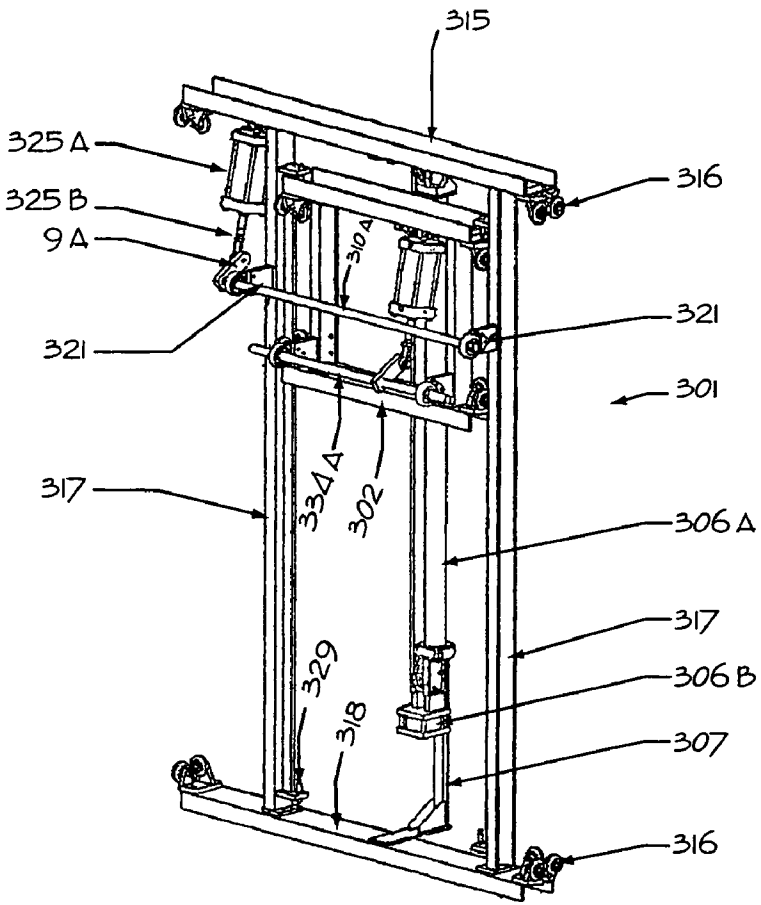
FIG. 24 is a perspective view of an embodiment of an outer carriage of the pod elevator with the inner carriage in the up position.
Figure 25:
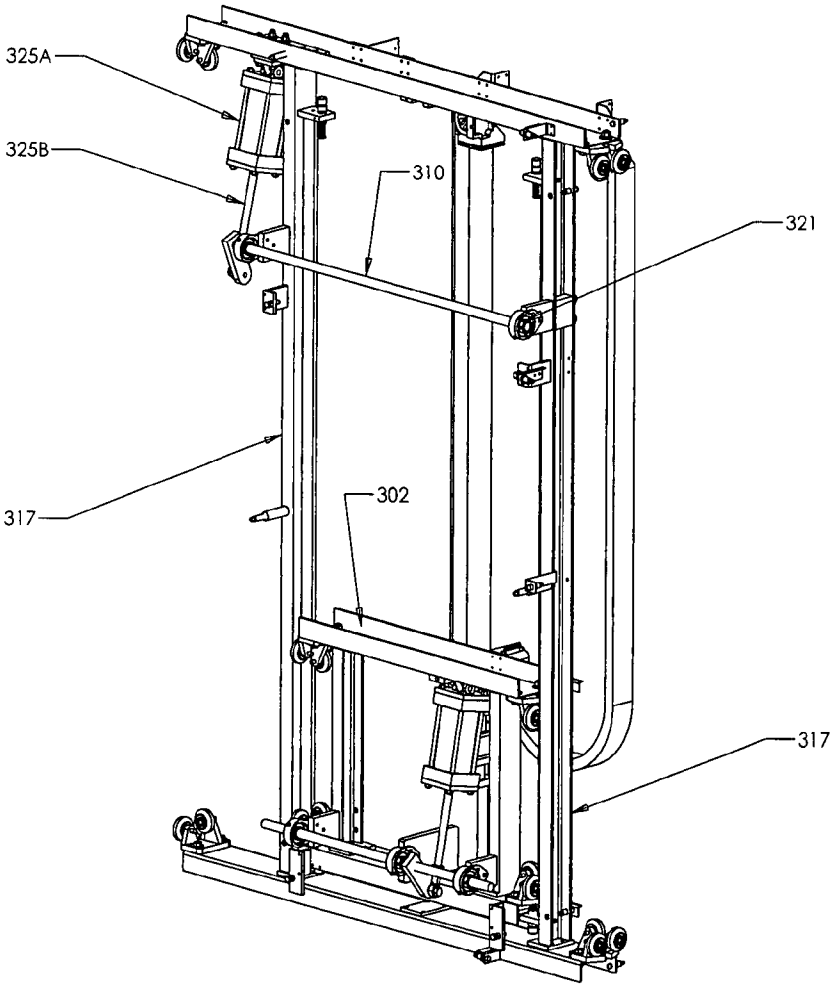
FIG. 25 is a perspective view of an embodiment of an outer carriage of the pod elevator with the inner carriage in the down position.
Figure 26:
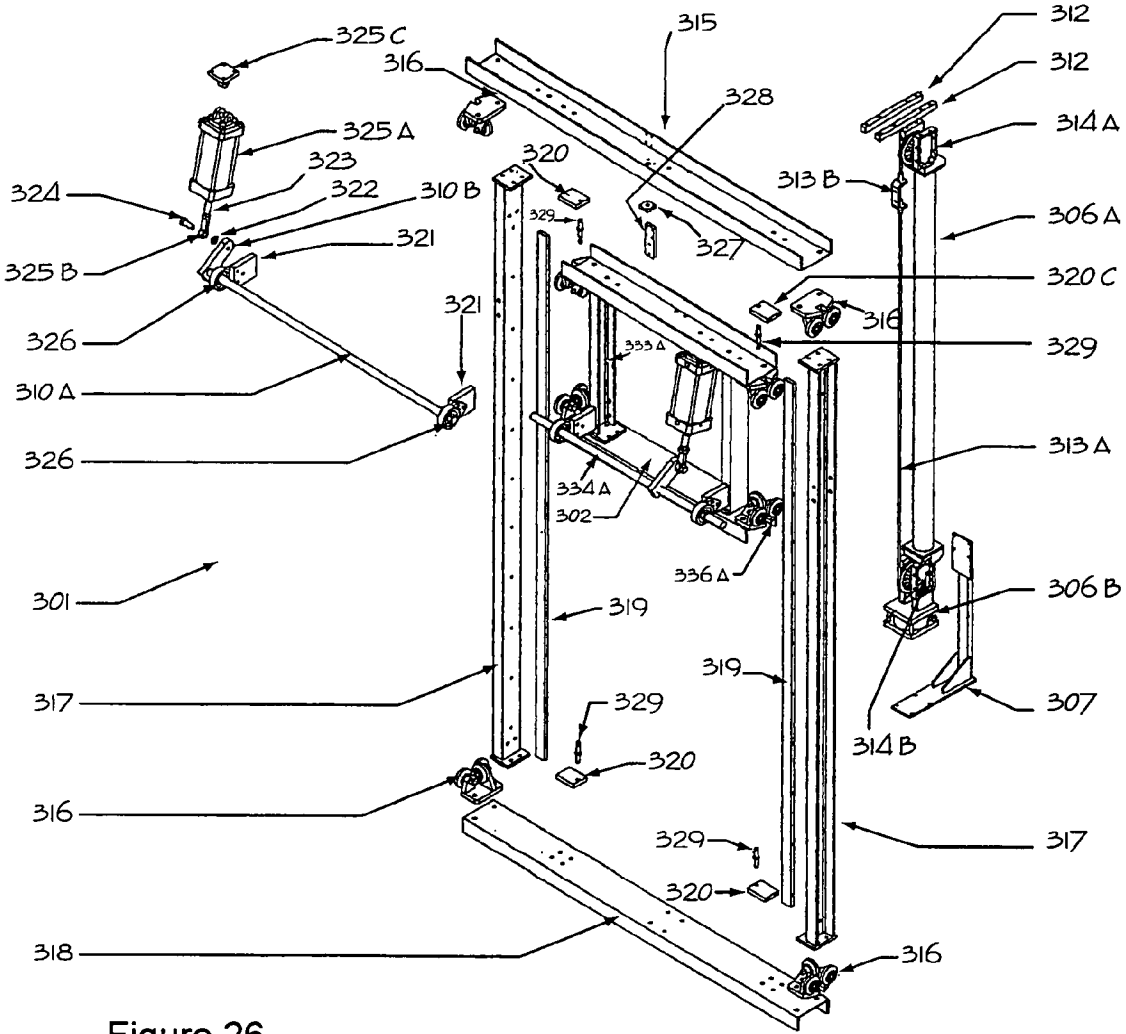
FIG. 26 is an exploded view of an embodiment of the outer carriage of the pod elevator with the inner carriage in the up position.
Figure 27:
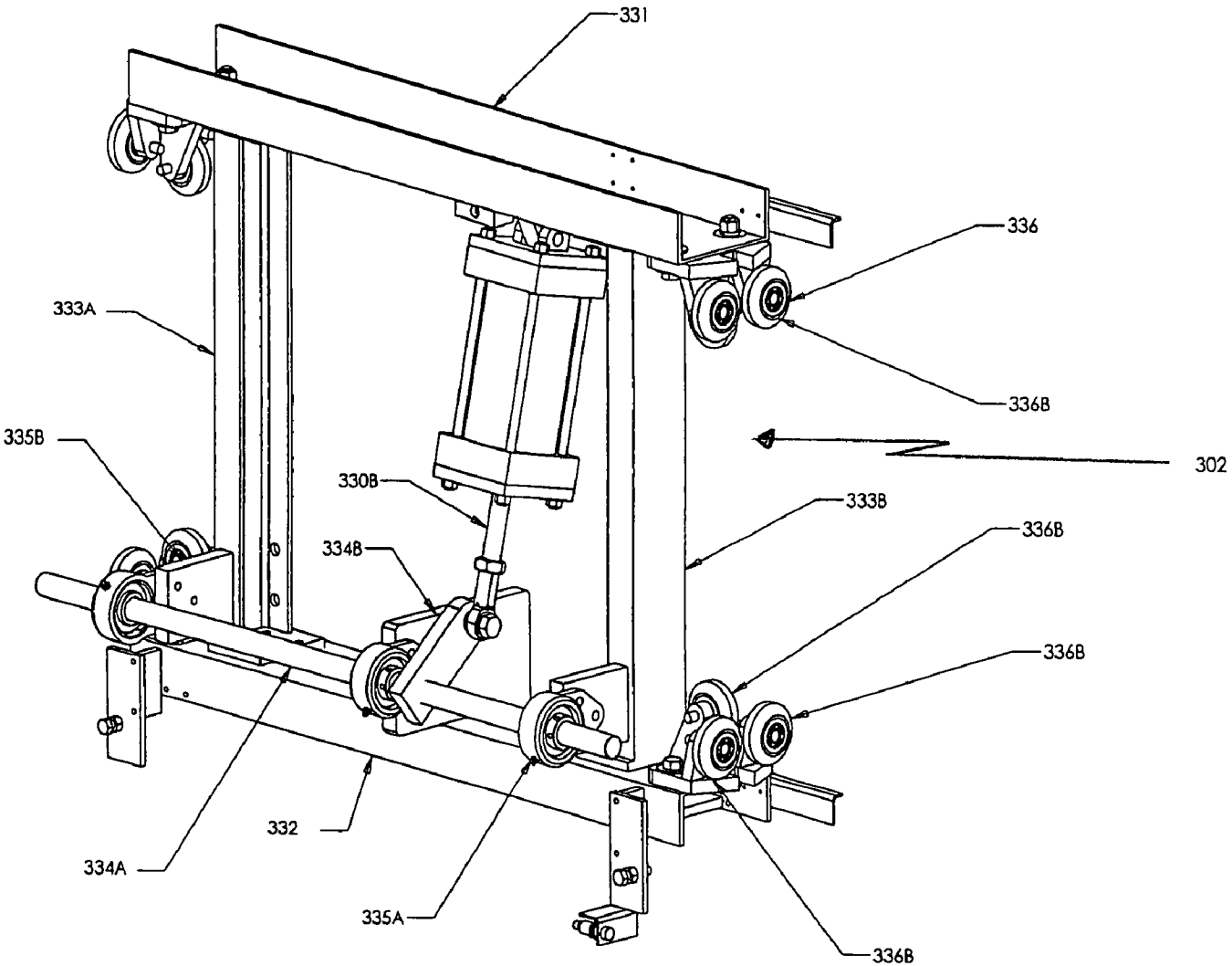
FIG. 27 is a perspective view of an embodiment of inner carriage of the pod elevator.
Figure 29:
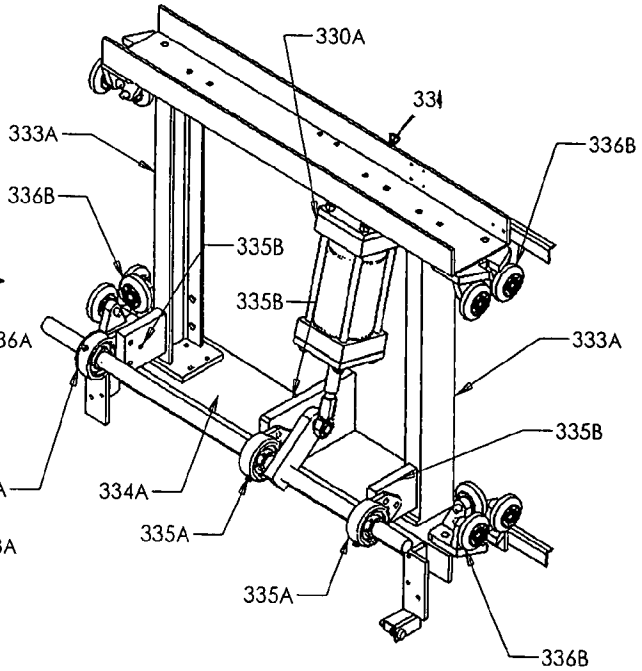
FIG. 29 is a perspective view of an embodiment of the inner carriage of the pod elevator.
Figure 28:
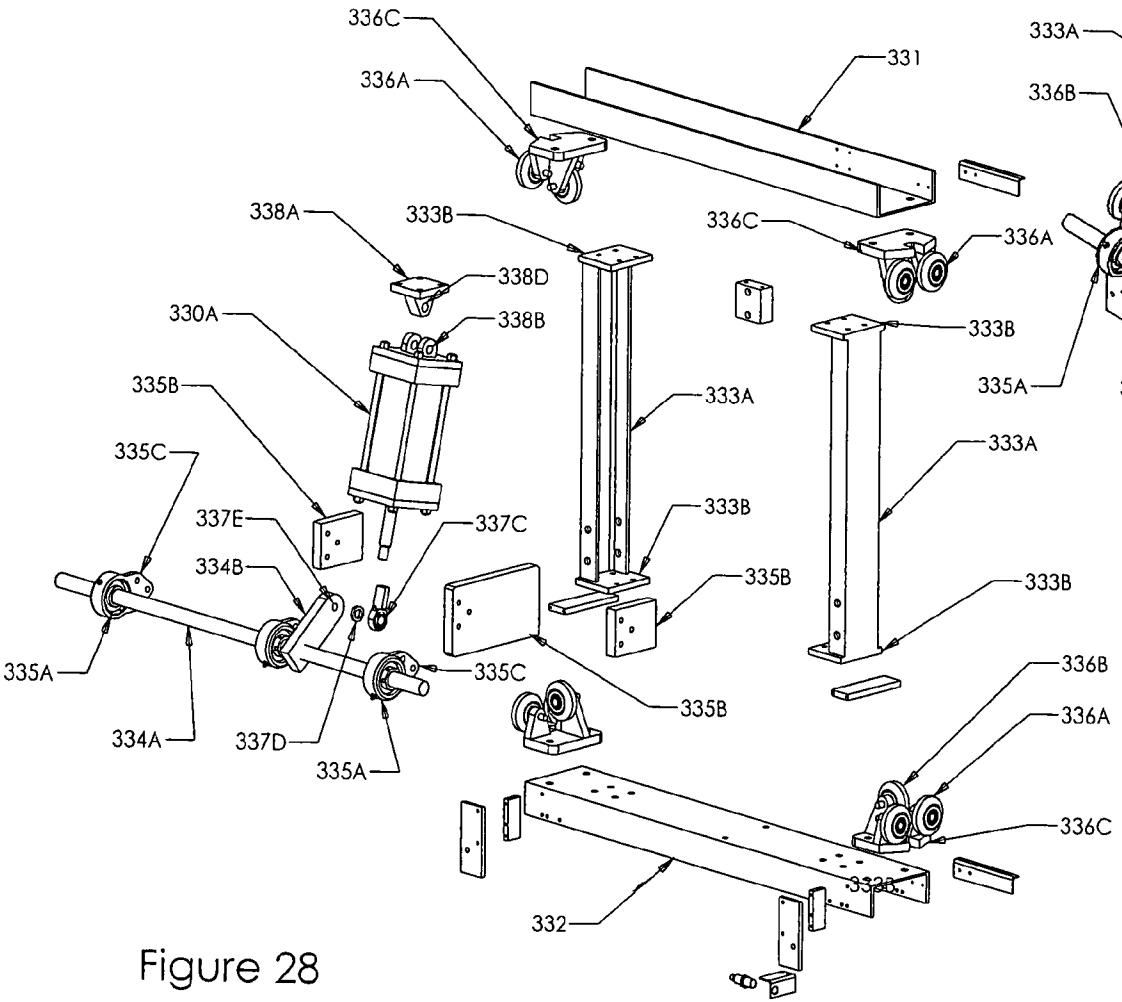
FIG. 28 is an exploded view of an embodiment of the inner carriage of the pod elevator.

The operating parts of pod elevator are outer carriage 301 and inner carriage 302. FIGS. 24-26 illustrate the structure of outer carriage 301 and to some degree, inner carriage 302. FIG. 24 illustrates inner carriage 302 in an up-position relative to outer carriage 301. FIG. 25 illustrates inner carriage 302 in a down-position relative to outer carriage 301. FIG. 26 is an exploded view of the structure of outer carriage 301 and to some degree, inner carriage 302. FIGS. 27-29 illustrate inner carriage 302.

The exploded view of FIG. 26 best illustrates the structure of outer carriage 301. The frame of outer carriage 301 includes bottom angle bracket 318, left and right side channels 317, and top angle bracket 315. Each frame member is securely bolted or welded together. Left and right guide rails 319 are affixed to the insides of left and right side channels 317 and run more or less the full length of left and right side channels 317. Four guide roller assemblies 316 lie outboard of side channels 317; a pair mounted on the top of bottom angle bracket 318 and a pair on the bottom of top angle bracket 315. Shock absorbers 329 are mounted on shock mounts 320 at the top and the bottom of guide rails 319. They project upward from the bottom of the guide rails 319 and downward from the top of guide rails 319 to absorb whatever light shock may occur when inner carriage 302 bottoms out at the end of its downward travel along guide rails 319 and when it tops out at the end of its upward travel along guide rails 319. Cable cylinder 306A is attached to bottom angle bracket 318 by intermediate mount 307. Mount 307 offsets cylinder 306A from bracket 318 to allow clearance between inner carriage 302 and the cable cylinder. Likewise, cylinder plate mounts 312 perform the same function at the top of cable cylinder 306A. Cable 313A is attached to the top angle bracket of inner carriage 302 by cable travel stop 313B so that cable cylinder motor 306B is able to move inner carriage 302 up and down within outer carriage 301 as and when signaled to do so by the system PLC (not shown).

FIGS. 27-29 illustrate inner carriage 302. Inner carriage 302 is similar in certain respects to outer carriage 301. Inner carriage 302 is comprised of left and right side channels 333A and 333B. Each channel has mounting bracket at its top and bottom for mounting channels 333A and 333B to top angle bracket 331 and to bottom angle bracket 332. Guide roller assemblies 336B are affixed to the top surface of bottom angle bracket 332 and to the bottom surface of top angle bracket 331. With reference to FIG. 28, guide roller assemblies 336A include rollers 336B and mounting brackets 336C on which rollers 336B are rotatably affixed. Shaft 334A has bearing 335A at each end. Each bearing has a mounting flange 335C. Mounting flanges 335C are attached to bearing mounts 335B, which in turn are affixed to side channels 333A. Pivot 334B is affixed to shaft 334A between bearings 335A. Pivot arm 334B is connected to the cylinder rod of cylinder 330A by a cylinder attachment assembly. This assembly includes, for example, a threaded bolt u an aperture 337C in a cylinder rod end, a spacer 337D, and an aperture 337E in pivot arm 334B. Cylinder 330A is attached to a clevis mounting plate inserted by pin 338B through eyes 338B of cylinder 330A and through eye 338D of clevis mounting plate 338A. Mounting plate 338A is mounted to the bottom of top angle bracket 331.

FIGS. 19-23 illustrate pod elevator 4 with two pods 3 mounted therein. Pods 3 are initially stacked horizontally in elevator 4, prior to putting the elevator in service. The pods are an integral part of elevator 4. They are not intended to be removed in the normal course of the printing operation. However, the pods can be removed with little difficulty and used to store the lithographic plates for use at a later time.

Figure 21:
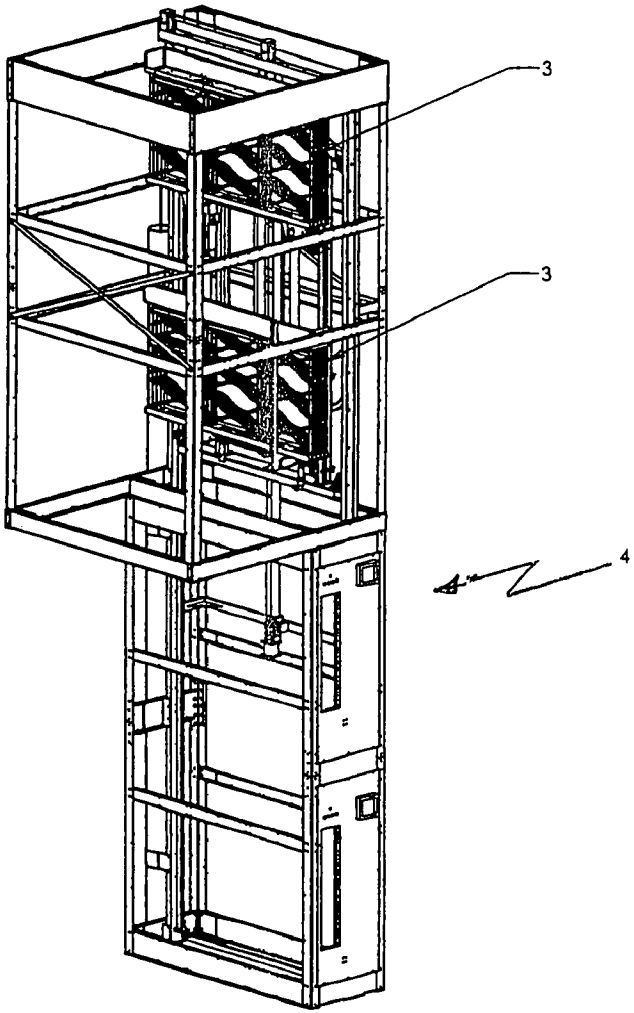
FIG. 21 is a perspective view of an embodiment of the pod elevator in the rotate pod mode.
Figure 22:
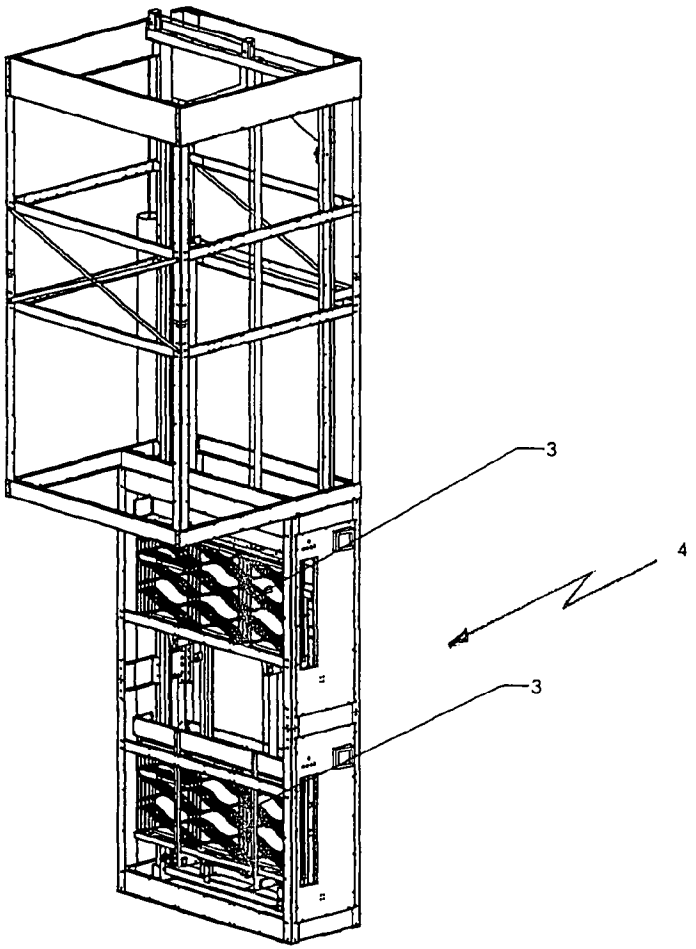
FIG. 22 is a perspective view of an embodiment of the pod elevator in the lowering pod mode.

As previously mentioned and as shown in FIG. 19, an embodiment of elevator 4 has two pods 3. The upper pod is held by outer carriage 301 of FIG. 24. The lower pod is held by inner carriage 302. L-shaped supports 206 can be seen on the top of the upper pod. FIG. 26 shows shaft 310A. The shaft extends through keyless hubs 209 in each L-shaped support of the upper pod. Shaft 310A is rotatably held in bearings 326, which are affixed to left and right side channels 317 of elevator 4 (FIGS. 24-26). Shaft 310A inserts into an aperture in one end of pivot 310B of the upper pod and is non-rotatably affixed in the angular position shown in FIGS. 24 and 26. Cylinder rod 325B of cylinder 325A is rotatably connected to pivot arm 310B at the other end of pivot 310B. The top end of cylinder 310A is pivotally connected to the bottom of top angle bracket 315. When cylinder 310A is actuated by the system controller, rod 325B moves downward, rotates shaft 310A clockwise 90°, and likewise rotates upper pod 3 clockwise 90°. Shaft 310A rotates pod 3 clockwise 90° due to the fact that shaft 310A is gripped by the two keyless hubs 209 on pod 3. The clockwise rotation of pod 3 around shaft 310A forces enclosure 217 of the upper pod to also rotate 90° with the result that the formerly horizontal upper pod is now vertical with enclosure 217 above channel shaped retainer 208, as can be seen in FIG. 21. Rotation of the lower pod occurs in the same manner as for the upper pod. The difference is that lower pod 3 is pivoted around shaft 334A of inner carriage 302 rather than shaft 310A of outer carriage 301. Lower pod is also oriented differently than upper pod, in that L-shaped supports 206 are on the bottom of lower pod 3. L-shaped supports 206 mounted in this manner so that the two pods are abutting one another in the load plate mode. When abutting, the spacing of the partitions of pod 3 are close enough together so that the upper and lower pods appear to indexer 2 to be a single larger pod. This allows for more efficient loading of the two pods by indexer 2.

The operation of elevator 4 includes six sequential modes.

The first mode shown in FIG. 19 is the "load plate" mode. In the load plate mode, indexer 2 loads bar coded plates into an identified compartment 200 of an identified pod 3, of which there are two. Prior to loading the plates, a bar code reader on indexer 2 reads the bar code of the plate to be loaded. Identifiers for pod 3 and for the compartment 200 (in which the plate will be loaded) in identified pod 3 are sensed by magneto-resistive transducer 144 mounted on indexer 2. Transducer 144 senses each indexed position of the indexer's elevator 100 as it moves upwardly or downwardly within indexer housing 113. Each indexed position corresponds to the position of a specific compartment 200 in a specific pod 3. The identifier for the compartment, the identifier for the pod, and the bar coded information on the plate is fed back to the system PLC of the plate management and handling system and are stored in the PLC's memory. As shown in FIG. 19, upper pod 3 is hung on outer carriage 301 by shaft 310A and is affixed to shaft 310A by keyless hubs 209 of upper pod 3. Lower pod 3 is hung on inner carriage 302 by shaft 334A and is affixed to shaft 334A by keyless hubs 209 of lower pod 3.

Figure 20:
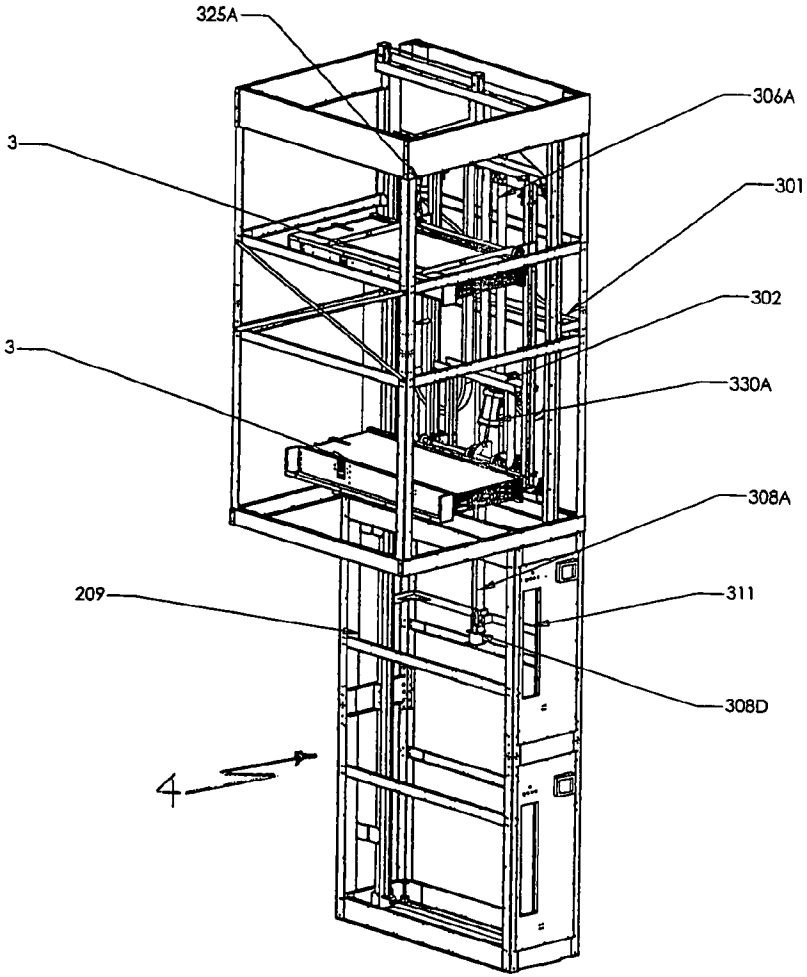
FIG. 20 is a perspective view of an embodiment of the pod elevator in the pod separation mode.

The second mode shown in FIG. 20 is the "separate pod" mode. In this mode, adjacent upper and lower pods 3 of FIG. 19 are vertically separated. During separation, upper pod 3 remains stationary in the load plate position. Upper pod 3 is connected to outer carriage 301, which consequently also remains stationary. Lower pod 3 is connected to inner carriage 302. Inner carriage 302 rides within outer carriage 301. Separation of lower pod 3 from upper pod 3 occurs when inner carriage 302 moves downward within outer carriage 301. Inner carriage 302 moves downward when it receives a signal do so from the system PLC. Upon receiving the signal, inner carriage 302 is moved down to the bottom of outer carriage 301 by inner carriage cable 313A and its associated parts, comprising four inner carriage cable roller assemblies 336A, inner carriage cable attachment point 313B, inner carriage cable cylinder 306A, and inner carriage cable motor 306B. Inner carriage 302 rides up and down on inner carriage rails 319A and B. Rails 319A and B are captured by the three guide rollers 336B of guide roller assembly 336A. The lower pod is separated from the upper pod by at least a distance equal to the width of pod 3. The width of pod 3 is defined by the distance from the outside of channel shaped retainer 208 to the outside of enclosure 217. During and initially after pod separation, the pods remain in a horizontal position.

Figure 23:
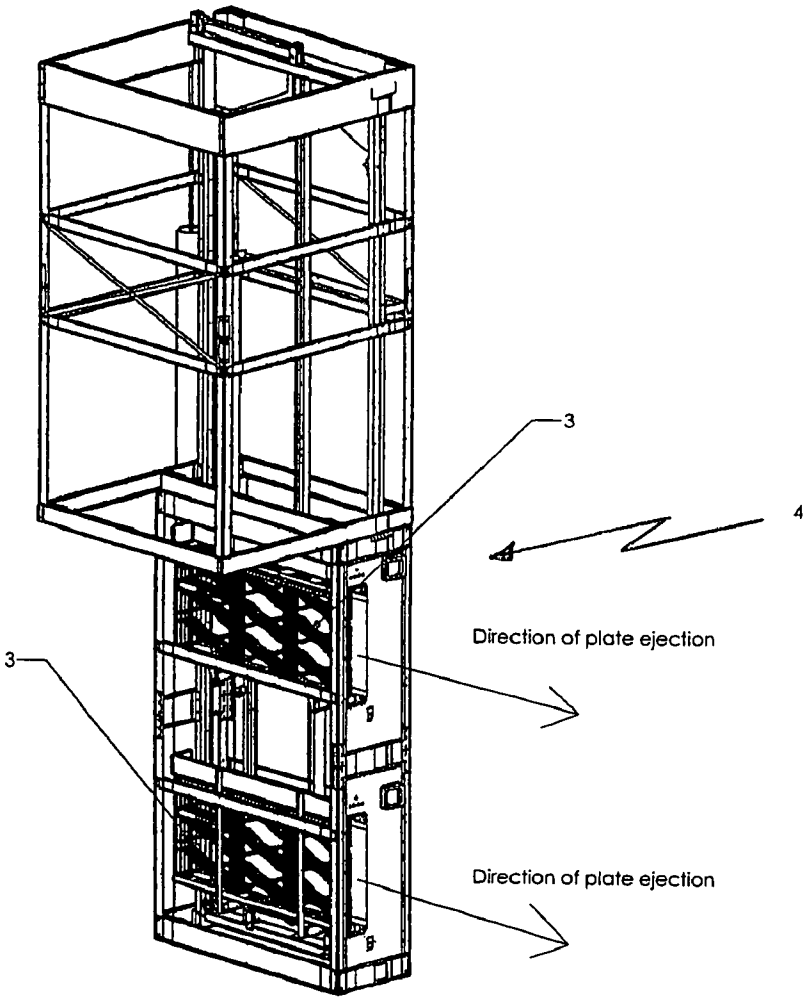
FIG. 23 is a perspective view of an embodiment of the pod elevator in the ejecting plate mode.

The third mode shown in FIG. 23 is the "rotate pod" mode. In this mode, as previously described, each pod is rotated upwards 90° from its horizontal orientation to a vertical orientation.

The fourth mode shown in FIG. 24 is the "lower pod" mode. In this mode, both of the vertically hung pods of FIG. 23 are moved downwards to the bottom of elevator 4. Downward movement of both of the pods occurs simultaneously by downward movement of outer carriage 301. Outer carriage 301 contains inner carriage 302 and its associated pod. Inner carriage 302 was moved in the lowest position within outer carriage 301 during the "separate pod" mode. Outer carriage 301 moves downward when it receives a signal from system controller to do so. Upon receiving the signal, outer carriage 301 is moved down to the bottom of pod elevator 4 by outer carriage cable 308B and its associated parts, comprising four outer carriage cable roller assemblies 316, outer carriage cable attachment point (not shown), outer carriage cable cylinder 308A, and outer carriage cable motor 308D. Outer carriage 301 rides up and down on outer carriage rails 319. Rails 319 are captured by guide roller assemblies 316, which are each comprised of 3-rollers.

The fifth mode shown in FIG. 25 is the "eject plate" mode. After the pod elevator's delivery of the plate to a press area, the system controller sends the plate's bar coded information and identifiers for compartment 200 and pod 3 (sometimes referred to as the plate address) to the press-person. The information is most conveniently provided on an electronic display. Among other information, the information tells the press-person on which cylinder the ejected plate is to be placed. In this mode, the press-person signals the system controller to eject the identified plate out of its pod compartment 200 into the hands of the press operator. The press operator then locks the plate on the cylinder designated by the information sent to the display by the system controller.

The sixth mode is the "return home mode." In this mode, the system controller directs pod elevator to return to its home position for further loading of the pods by indexer 2. The sixth mode reverses the sequence of the previously described five modes.

Although the apparatus for loading lithographic plates into a container for transport to a press cylinder and the process thereof have been described with reference to the embodiments, those skilled in the art will recognize that numerous changes may be made in form and detail without departing from the spirit and scope of the apparatus and process.

We claim:

1. A system for organizing and transporting a plurality of lithographic plates from an indexer station to a print cylinder loading station at a location vertically offset relative to the indexer station comprising (a) an indexer module adapted to receive imaged lithographic plates, one at a time, the indexer module including a frame supporting a conveyor having a horizontally movable member for transporting lithographic plates thereon and an indexer elevator mechanism for vertically displacing the horizontally movable member;

(b) a pod elevator including a pod loading station and a pod unloading station vertically offset from one another;

(c) a pod comprising a pod housing divided by partitions into a plurality of compartments, each compartment adapted to receive a single lithographic plate therein from the indexer module, said compartments being horizontally oriented when said pods are being loaded in the pod loading station of the pod elevator;

(d) a controller coupled to the indexer for actuating the indexer elevator mechanism and the horizontally movable member for loading imaged lithographic plates into predetermined ones of the plurality of compartments at the pod loading station; and (e) a pod rotating device in the pod elevator for rotating the loaded pods from a horizontal disposition to a vertical disposition in the pod loading station before translating the filled pods to the pod unloading station.

2. The system as in claim 1 wherein the lithographic plates are bent into an inverted V-shape along opposed side edges thereon, said lithographic plates being suspend from one of the bent edges within a pod compartment upon rotation of the loaded pods by the pod rotating device.

3. The system as in claim 1 wherein the pod elevator is adapted to contain plural pods, each pod including a plurality of compartments.

4. The system as in claim 1 wherein the indexer elevator mechanism of the indexer module is vertically movable within the frame and conveyor such that when the indexer elevator mechanism is in a first position the conveyor is in a plate indexer loading position and when the indexer elevator mechanism is in a second position, the conveyor is a plate pod loading position.

5. The system of claim 4 wherein the indexer elevator mechanism comprises an electrical drive motor coupled in driving relation to a worm gear assembly by a speed reduction adapter for raising and lowering the indexer elevator mechanism.

6. The system of claim 1 wherein the horizontally movable member comprises at least one horizontally directed endless belts and means for moving the belts.

7. The system of claim 6 wherein said partitions comprise a plurality of generally parallel rails supported at opposed ends by rail support members and said partitions including a plate hanger extending between the rail support members proximate a side edge of the partition.

8. The system of claim 1 wherein the pod housing comprises first and second side plates held in parallel, spaced apart relation by a pair of L-shaped supports.

9. The system of claim 8 wherein said pair of L-shaped supports on the pod housing include keyless hubs extending through a thickness dimension of one leg of the L-shaped supports and the pod rotating device comprises a shaft extending through said keyless hubs, the shaft being rotatable by a linear actuator coupled through a crank arm to said shaft.

10. The system of claim 1 wherein the pod elevator comprises an outer carriage movable within an elevator support frame and adapted to support a first pod that is movable within the outer carriage; and an inner carriage movable within the outer carriage adapted to support a second pod within the inner carriage.

11. The system of claim 10 wherein the elevator support frame includes a top portion and a bottom portion where the top portion is cantilevered over the bottom portion.

12. The system of claim 10 and further including pod support pivots in the pod elevator for permitting rotation of the first and second pods between a horizontal disposition and a vertical disposition.

* * * * *